US008216423B2

(12) United States Patent
Xu

(10) Patent No.: US 8,216,423 B2
(45) Date of Patent: Jul. 10, 2012

(54) MULTI-STAGE AP MECHANICAL PULPING WITH REFINER BLOW LINE TREATMENT

(75) Inventor: Eric Chao Xu, Miamisburg, OH (US)

(73) Assignee: Andritz Inc., Muncy, PA (US)

( * ) Notice: Subject to any disclaimer, the term of this patent is extended or adjusted under 35 U.S.C. 154(b) by 0 days.

(21) Appl. No.: 12/661,907

(22) Filed: Mar. 26, 2010

(65) Prior Publication Data

US 2010/0263815 A1 Oct. 21, 2010

Related U.S. Application Data

(63) Continuation of application No. 10/677,545, filed on Oct. 2, 2003, now abandoned, which is a continuation-in-part of application No. PCT/US02/23078, filed on Jul. 19, 2002.

(60) Provisional application No. 60/306,974, filed on Jul. 19, 2001.

(51) Int. Cl.
*D21C 9/16* (2006.01)
*D21B 1/02* (2006.01)
*D21B 1/04* (2006.01)

(52) U.S. Cl. ..... 162/25; 162/26; 162/52; 162/56; 162/261; 241/27; 241/28; 8/107; 8/111

(58) Field of Classification Search ..... 162/23–26, 162/52, 56, 78, 261; 241/23, 27, 28; 8/101, 8/107, 111
See application file for complete search history.

(56) References Cited

U.S. PATENT DOCUMENTS 3,023,140 A 2/1962 Textor
4,040,743 A 8/1977 Villaume et al.
4,187,141 A 2/1980 Ahrel
4,270,976 A 6/1981 Sandstrom et al.
4,294,653 A 10/1981 Lindahl et al.
4,311,553 A 1/1982 Akerlund et al.
4,486,267 A 12/1984 Prusas
4,718,980 A 1/1988 Lowrie et al.
4,756,799 A 7/1988 Bengtsson et al.
4,849,053 A * 7/1989 Gentile et al. ..... 162/76
4,900,399 A 2/1990 Bengtsson et al.
5,776,305 A 7/1998 Sabourin
6,258,207 B1 * 7/2001 Pan ..... 162/27

(Continued)

FOREIGN PATENT DOCUMENTS

CA 1 078 558 6/1980

(Continued)

OTHER PUBLICATIONS

Smook, Gary A., Handbook for Pulp and Paper Technologists, 2nd ed, Angus Wilde Publications, 1992, p. 98.*

(Continued)

*Primary Examiner* — Matthew Daniels
*Assistant Examiner* — Dennis Cordray
(74) *Attorney, Agent, or Firm* — Nixon & Vanderhye, PC

(57) ABSTRACT

The invention combines the step of adding chemicals such as alkaline peroxide to an intermediate line after refining, with the step of applying chemicals such as alkaline peroxide as a pre-treatment before primary refining and/or applying chemicals such as alkaline peroxide at the primary refiner. This is implemented in the preferred embodiment, by pre-treating feed material, refining the materials into a pulp in a superatmospheric refiner, and adding chemicals in the post refining blowline.

33 Claims, 20 Drawing Sheets

U.S. PATENT DOCUMENTS

| | | | | |
|---|---|---|---|---|
| 6,458,245 | B1 | 10/2002 | Hoglund et al. | |
| 6,743,332 | B2 | 6/2004 | Haynes et al. | |
| 6,881,299 | B2 | 4/2005 | Parrish et al. | |
| 7,758,720 | B2 | 7/2010 | Sabourin | |
| 7,758,721 | B2 | 7/2010 | Sabourin | |
| 7,892,400 | B2 | 2/2011 | Sabourin | |
| 8,048,263 | B2 * | 11/2011 | Herkel et al. | 162/25 |
| 2001/0050151 | A1 | 12/2001 | Sabourin | |
| 2004/0069427 | A1 | 4/2004 | Xu | |
| 2004/0200586 | A1 | 10/2004 | Herkel | |
| 2005/0011622 | A1 | 1/2005 | Sabourin | |
| 2008/0035286 | A1 | 2/2008 | Aichinger et al. | |
| 2008/0066877 | A1 | 3/2008 | Sabourin | |
| 2008/0105391 | A1 | 5/2008 | Sabourin | |
| 2008/0142181 | A1 | 6/2008 | Sabourin | |
| 2009/0151880 | A1 | 6/2009 | Aichinger et al. | |
| 2009/0288789 | A1 | 11/2009 | Sabourin et al. | |
| 2010/0186910 | A1 | 7/2010 | Herkel et al. | |
| 2010/0224333 | A1 | 9/2010 | Duggirala et al. | |
| 2010/0269994 | A1 | 10/2010 | Pranovich et al. | |

FOREIGN PATENT DOCUMENTS

| | | | |
|---|---|---|---|
| CA | 1 173 604 | | 9/1984 |
| JP | 2008-045262 | A | 2/2008 |
| SE | 226 593 | | 7/1968 |
| SE | 7502059-4 | | 8/1976 |
| SE | 454 185 | | 4/1988 |
| WO | 95/34711 | | 12/1995 |
| WO | 03/008703 | | 1/2003 |
| WO | 2005/042830 | A1 | 5/2005 |

OTHER PUBLICATIONS

Cannell, E. and Cockran, R., "The future of BCTMP". Pulp and Paper, May 2000, pp. 61-76.*

Heimburger, S. Quick, T. Sabourin, M., Trmblay, S., and Shaw, G., "One and two stage AP-TMP™—a route to high brightness pulp". Tappi Joumal vol. 79: No. 8 (1996), pp. 139-144.*

Xu, Eric C., "Chemical Treatment in Mechanical Pulping—Part 3; Pulp Yield and Chemical Pretreatment", 1998 Pulping Conference, TAPPI Proceedings, pp. 391-402.*

Office Action mailed Sep. 16, 2010 issued on co-pending U.S. Appl. No. 12/661,909.

Strunk, W. G. and Meng, T., "Status Report: Pulp Bleaching with Hydrogen Peroxide During Refining", Pulp and Pater 60 (11), 1986.

Xu, E.C., Sabourin, M.J., and Cort, J.B., "Evaluation of APMP and BCTMP Processes for Market Pulp Properties from South American Eucalyptus Species", 1996 Tappi Pulping Conference Proceedings, p. 705.

Xu, E.C., "Chemical Treatment in Mechanical Pulping, Part 1: South American Eucalyptus (Process and Properties)", 1997 Tappi Pulping Conference Proceedings, p. 985.

Xu, E.C., "Chemical Treatment in Mechanical Pulping, Part 2: North American Aspen (Process and Properties)". 1998 CPPA Technical Section Annual Meeting Proceedings, p. B51.

Xu, E.C., "Chemical Treatment in Mechanical Pulping, Part 3: Pulp Yield and Chemical Pretreatment", 1998 Tappi Pulping Conference Proceedings, p. 391.

Xu, E.C., "Properties and Papermaking Potential of APMP Pulp from Acacia Mangium", 52$^{nd}$ APPITA Annual General Conference Proceedings, (Brisbane, Australia, May 11-16, 1998), pp. 501-508.

Sferraza, M.J. and Bohn, W.L., Alkaline Peroxide Mechanical Pulping: The Pulp of the 1990's, 22$^{nd}$ ABTCP Pulp and Paper Annual Meeting, (San Paulo, Brazil, Nov. 20-24, 1989.

Gentile, V.M., Tschichirner, U., and Wilder, H.D., "The Scott Paper Alkaline Peroxide High Yielding Pulping Process", 1991 International Mechanical Pulping Conference Proceedings, p. 199.

Heitner, C., Beatson, R.P., and Atack, D., "Ultra-High Yield Pulping Part V: High Compression Impregnation of Softwood Chips with Sodium Sulphite—A Method of Producing CMP with High Wet and Dry Strength", paperi ja Puu (8): 417 1985.

Sharpe, P.E., and Rothenburg, I., "Refiner Hydrogen Peroxide Bleaching of Thermomechanical Pulps", Tappi Journal 71 (5): 109, 1988.

Springer, R., Huang, Y., Davies, D., Kronis, J., and Heimburger, S., "Refiner Peroxide Bleaching at Daishowa Port Angeles", 84$^{th}$ CPPA Annual Meeting Proceedings, p. A11.

Marton, R., Geoff, S., Brown, A.F., and Granzow, S., "Harwood TMP and RMP Modifications", Tappi Journal 62:1, p. 49, 1979.

Bohn, W and Sferrazza, M., "Alkaline peroxide mechanical pulping: a revolution in high yield pulping", 1989 International Mechanical Pulping Conference Proceedings, Helsinki, Finland.

Cannell, E. and Cockran, R., "The future of BCTMP", Pulp and Paper, May 2000, pp. 61-76.

Sabourin, M. and Presley, J., Low chemical alkaline peroxide TMP—a means for upgrading newsprint mills, 1992 Tappi Pulping Conference Proceeding, Book 3, pp. 1135-114.

Heimburger, S., Quick, T., Sabourin, M., Trmblay, S., and Shaw, G., "One and two stage AP-TMP—a route to high brightness pulp", Tappi Journal, vol. 79: No. 8, pp. 139-144, 1996.

Xu, E.C., "Mechanical Pulping of South American Eucalyptus—Technology, Pulp Properties and Application Potential", 1$^{st}$ ABTCP Pulping Technology Conference—San Paulo, Brazil, May 5-7, 1998.

Xu, E.C., "A New Concept in Alkaline Peroxide Mechanical Pulping", 1999 International Mechanical Pulping Conference Proceedings, Houston, May 24-26, 1999, p. 5A-3.

Xu, E.C., "A New Technology for Utilization of South American Eucalyptus in Paper and Board Manufacture", 32$^{nd}$ ABTCP Annual Conference, Sao Paulo, Brazil, Oct. 18-21, 1999.

Xu, E.C., "P-RC Alkaline Peroxide Mechanical Pulping of Hardwood Part 1—Aspen, Beech, Birch, Cottonwood and Maple" PATAC annual meeting proceedings, Montreal 2000.

Xu, E.C., "P-RC APMP Pulps from Asian Tropical Hardwoods", Asia Paper conference proceeding, Singapore, Apr. 23-27, 2000.

Xu, E.C., "Process Selection for Chemical Mechanical Pulping of Aspen" PAPTAC Annual Meeting Montreal, Jan. 29-Feb. 2001.

Xu, E.C., "P-RC APMP Pulping of Hardwood and its Comparison with Chemical Pulping", Intl. Symp. Environmentally Friendly and Emerging Technologies for a sustainable pulp and Paper Industry Conf. Proceeding, Taiwan, Apr. 25-27, 2000.

Office Action mailed Mar. 22, 2011 issued in co-pending U.S. Appl. No. 12/661,909.

* cited by examiner

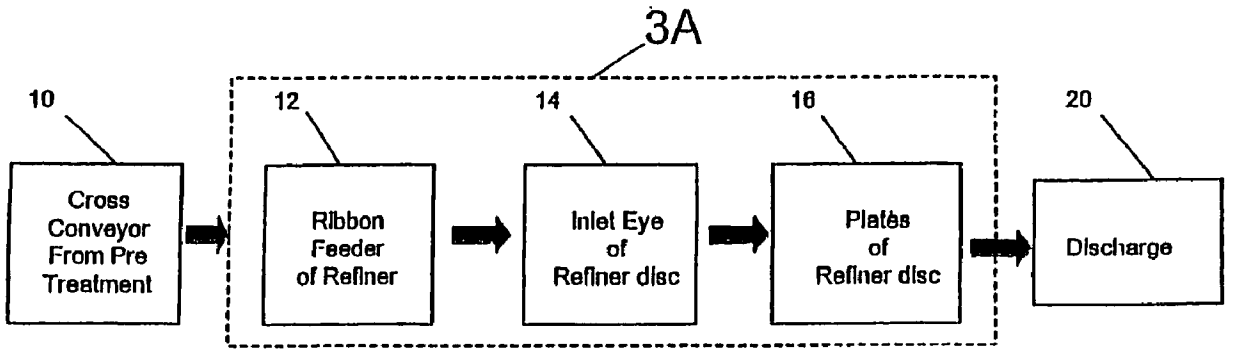
Figure IA
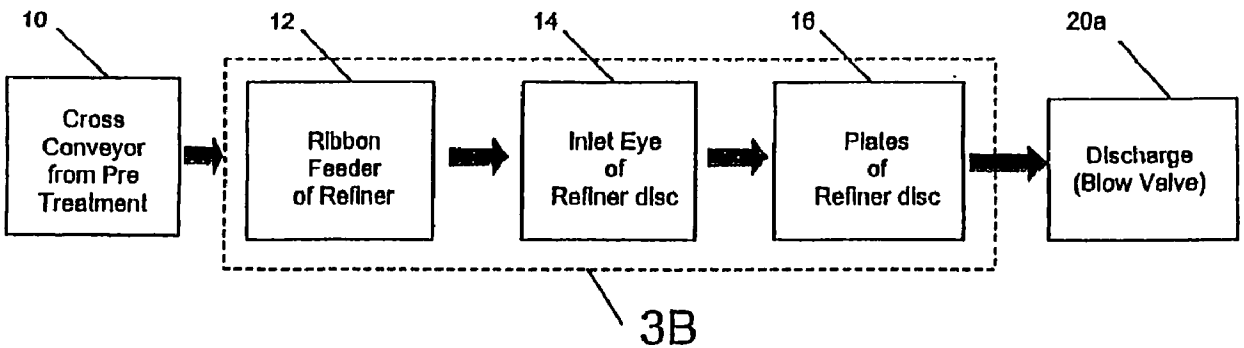
Figure IB

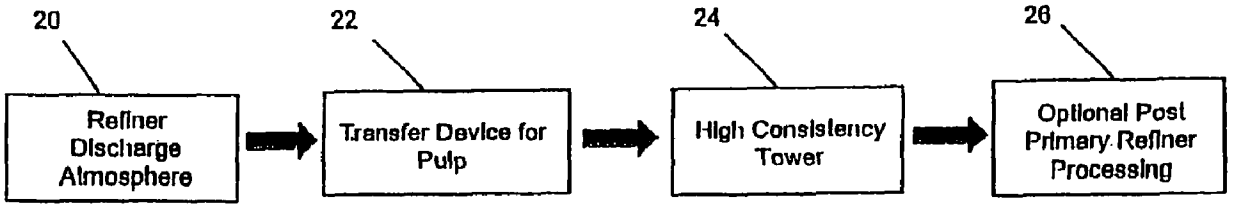
Figure IC
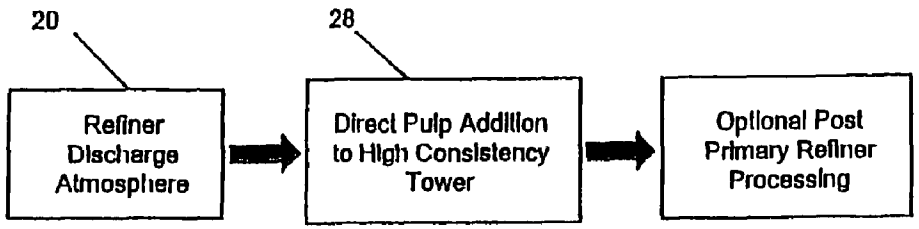
Figure ID
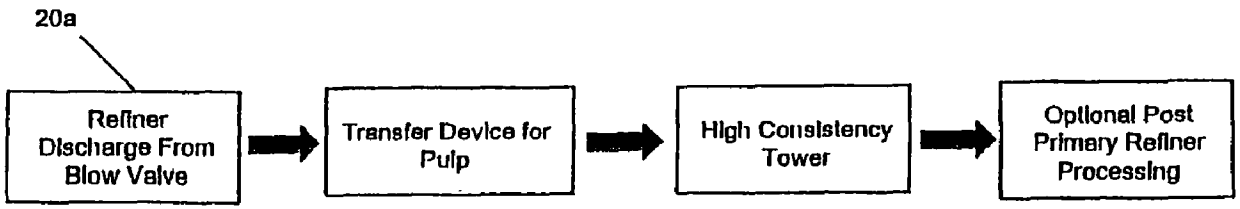
Figure IE
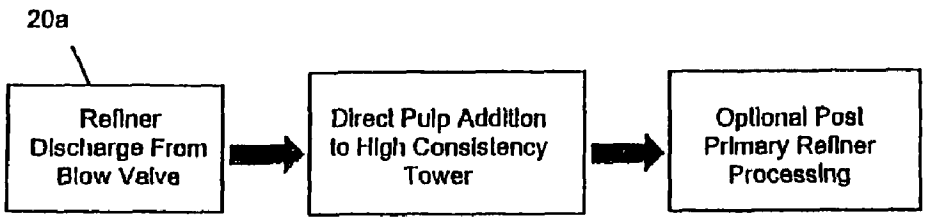
Figure IF

Figure 2

| SAMPLE | A2 | A3 | A4 | A10 | A11 | A12 | A14 | A15 | A16 |
|---|---|---|---|---|---|---|---|---|---|
| Chem. Applied: | Chip + Refiner | | | Chip | | | Refiner | | |
| % T.A. | 3.4 | | | 3.3 | | | 4.2 | | |
| % $H_2O_2$ | 2.6 | | | 2.4 | | | 3.3 | | |
| Residual: | | | | | | | | | |
| % $H_2O_2$ | 0.29 | | | 0.25 | | | 0.48 | | |
| pH | 8.2 | | | 8.6 | | | 8.2 | | |
| Total SEC (kwh/odmt)(a) | 947 | 1223 | 1543 | 874 | 1181 | 1531 | 1127 | 1389 | 1729 |
| CSF (mL) | 481 | 338 | 223 | 436 | 340 | 225 | 537 | 436 | 266 |
| TENSILE INDEX (N.m/g) | 16.4 | 21.9 | 29.3 | 18.4 | 25.1 | 31.1 | 11.4 | 17.1 | 24.9 |
| BULK (cm3/g) | 3.13 | 2.81 | 2.47 | 3.16 | 2.78 | 2.51 | 3.58 | 3.13 | 2.63 |
| BURST INDEX (kPa.m2/g) | 0.56 | 0.77 | 1.16 | 0.68 | 1.04 | 1.27 | 0.43 | 0.64 | 1.03 |
| TEAR INDEX (mN.m2/g) | 2.7 | 3.0 | 4.1 | 3.5 | 3.6 | 4.4 | 2.3 | 2.7 | 3.3 |
| T.E.A. (J/m2) | 5.7 | 9.0 | 15.5 | 7.2 | 11.9 | 16.7 | 3.2 | 6.5 | 11.3 |
| ISO BRIGHTNESS | 76.8 | 78.0 | 78.3 | 74.6 | 75.2 | 74.6 | 76.7 | 77.5 | 78.1 |
| % OPACITY | 84.4 | 85.2 | 86.8 | 85.0 | 85.6 | 85.3 | 83.7 | 86.1 | 86.3 |
| SCATT. COEFF. (m2/kg) | 50.7 | 53.4 | 57.7 | 49.2 | 52.3 | 52.7 | 48.4 | 53.3 | 57.1 |

Note: a) A commercial APMP system normally useds about 70% or less SEC than the lab.

Figure 9

| Aspen | Atmospheric | Pressurized |
|---|---|---|
| *First Stage Impregnation* | | |
| % DTPA | 0.2 | 0.2 |
| *Second Stage Impregnation* | | |
| % TA | 3.7 | 3.9 |
| % $H_2O_2$ | 3.3 | 3.0 |
| % Silicate | 3.4 | 3.3 |
| % $MgSO_4$ | 0.1 | 0.1 |
| *Primary Refiner* | | |
| Casing Pressure (kPa) | 0.0 | 140 |
| % TA | 1.8 | 2.0 |
| % $H_2O_2$ | 2.5 | 2.4 |
| % Silicate | 2.4 | 2.6 |
| % MgSO4 | 0.10 | 0.1 |
| *Final Pulp* | | |
| Brightness (% ISO) | 84.2 | 84.7 |
| pH Residual | 8.8 | 9.0 |
| % TA Residual | 0.3 | 0.5 |
| % $H_2O_2$ Residual | 2.1 | 1.5 |
| Total TA Consumed (%) | 5.2 | 5.4 |
| Total $H_2O_2$ Consumed (%) | 3.7 | 3.9 |

Figure 10

| Birch | Atmospheric | Pressurized |
|---|---|---|
| *First Stage Impregnation* | | |
| % DTPA | 0.2 | 0.2 |
| *Second Stage Impregnation* | | |
| % TA | 2.0 | 2.0 |
| % $H_2O_2$ | 2.3 | 2.3 |
| % Silicate | 2.4 | 2.4 |
| % $MgSO_4$ | 0.1 | 0.1 |
| *Primary Refiner* | | |
| Casing Pressure (kPa) | 0 | 140 |
| % TA | 1.3 | 1.3 |
| % $H_2O_2$ | 1.8 | 1.7 |
| % Silicate | 1.8 | 1.7 |
| % MgSO4 | 0.1 | 0.1 |
| *Final Pulp* | | |
| Brightness (% ISO) | 82.4 | 82.6 |
| pH Residual | 8.0 | 8.0 |
| % TA Residual | 0.2 | 0.1 |
| % $H_2O_2$ Residual | 0.5 | 0.6 |
| Total TA Consumed (%) | 3.1 | 3.2 |
| Total $H_2O_2$ Consumed (%) | 3.6 | 3.4 |

FIGURE 15

Results from Birch and Maple

| Wood | Birch | | Maple | |
|---|---|---|---|---|
| Dosing Point | Refiner Eye | Blow Line | Refiner Eye | Blow Line |
| Sample No. | A1 | A2 | A3 | A4 |
| *Conditions at Primary Refiner* | | | | |
| Pressure at Inlet (Bar) | 0 | 0 | 0 | 0 |
| Pressure in Casing (Bar) | 1.4 | 1.4 | 1.4 | 1.4 |
| % DTPA | 0.16 | 0.16 | 0.13 | 0.13 |
| % $MgSO_4$ | 0.16 | 0.16 | 0.13 | 0.13 |
| % Silicate | 2.3 | 2.3 | 2.5 | 2.5 |
| % TA (Residual) | 1.8 (0.3) | 1.8 (0.5) | 1.2 (0.1) | 1.2 (0.1) |
| % $H_2O_2$ (Residual) | 2.4 (1.0) | 2.4 (1.1) | 2.1 (1.8) | 2.1 (2.1) |
| Final pH | 8.9 | 9.0 | 7.4 | 7.6 |
| *Final Pulp Properties* | | | | |
| Brightness (% ISO) | 84.8 | 84.2 | 79.2 | 81.9 |
| Light Absorption Coefficient ($m^2/kg$) | 0.27 | 0.25 | 0.5 | 0.32 |
| Freeness (ml) | 285 | 315 | 320 | 295 |

FIGURE 16

Table 2. Results From Different Softwoods

| Wood | Spruce | | Red Pine | |
|---|---|---|---|---|
| Dosing Point | R.E. | B.L. | R. E. | B. L. |
| Sample No. | A5 | A6 | A7 | A8 |
| *Conditions at Primary Refiner* | | | | |
| Pressure at Inlet (Bar) | 0 | 0 | 0 | 1.73 |
| Pressure in Casing (Bar) | 0 | 1.73 | 0 | 1.73 |
| % DTPA | 0.22 | 0.22 | 0.2 | 0.18 |
| % $MgSO_4$ | 0.11 | 0.11 | 0.06 | 0.06 |
| % Silicate | 1.1 | 1.1 | 2.0 | 1.8 |
| % TA [a] (Residual) | 0.8 (0.1) | 0.9 (0.2) | 1.2 (0.5) | 1.2 (0.1) |
| % $H_2O_2$ (Residual) | 1.2 (1.3) | 1.2 (1.7) | 1.9 (1.1) | 1.8 (1.1) |
| Final pH | 8.7 | 9.1 | 8.1 | 8.1 |
| *Final Pulp Properties* | | | | |
| Brightness (% ISO) | 78.2 | 78.8 | 71.2 | 71.8 |
| Light Absorption Coefficient ($m^2$/kg) | 0.60 | 0.56 | 1.01 | 0.84 |
| Freeness (ml, CSF) | 49 | 47 | 82 | 99 |

FIGURE 17

Table 3. Results From Softwood Blend Under Elevated Pressure At Primary Refiner.

| Dosing Point<br>Sample No. | Refiner Eye<br>A9[a] | Blow Line<br>A10[a] |
|---|---|---|
| *Conditions at Primary Refiner* | | |
| Pressure at Inlet (Bar) | 2.1 | 4.3 |
| Pressure in Casing (Bar) | 2.1 | 4.3 |
| % TA | 1.7 | 1.7 |
| % $H_2O_2$ (Residual) | 2.8 (1.1) | 2.8 (1.1) |
| Final pH | 7.6 | 7.5 |
| *Final Pulp Properties* | | |
| Brightness (% ISO) | 73.7 | 73.4 |
| Light Absorption Coefficient ($m^2/kg$) | 1.1 | 0.96 |
| Freeness (ml) | 47 | 57 |

MULTI-STAGE AP MECHANICAL PULPING WITH REFINER BLOW LINE TREATMENT

REFERENCE TO RELATED APPLICATIONS

The present application is a continuation of U.S. application Ser. No. 10/677,545 filed Oct. 2, 2003 now abandoned , which is a continuation-in-part of International Application No. PCT/US0223078 under 35 U.S.C. §365(c) filed Jul. 19, 2002 (designating the U.S.) which claims benefit under 35 U.S.C. §119(e) of U.S. Provisional Application No. 60/306,974 filed Jul. 19, 2001.

FIELD OF THE INVENTION

The present invention relates to a process for the production of pulp from lignocellulosic material, such as wood chips or the like, by chemical-mechanical refining.

BACKGROUND OF THE INVENTION

Applying alkaline peroxide chemicals in a mechanical pulping system (APMP) may be traced back as early as 1962. Since then, there have been a number of different process ideas developed to apply the chemicals before or during early stages of refiner pulping. In recent years, an extensive and systematic investigation has been reported on how different chemical treatments in refiner mechanical pulping affect pulp property development and the process consumption. For hardwoods, it was observed that alkaline peroxide pretreatment in general gives better optical properties, better bleachability and higher pulp yield at similar strength properties when compared to other conventional chemical pretreatment, such as alkaline sulfite and cold caustic soda processes. When compared to a peroxide post-bleaching process, applying alkaline peroxide before refining has a tendency to give a higher bulk at a given tensile strength for some hardwood species, such as North American aspen.

In a very broad sense, alkaline peroxide refiner mechanical pulping is a type of pulping process where hydrogen peroxide and alkali in various forms, together with various amounts of different peroxide stabilizers, are applied to the lignocellulosic materials before or during defiberization and fibrillation in a refiner. In the early stage of development of this type of pulping process, two basic concepts were tried. One was to apply alkaline peroxide treatment on chips, to allow the bleaching reactions to complete or to approach completion before refining. The other basic concept was to apply all the alkaline peroxide at the refiner, either with no pretreatment or with stabilizers or other alkaline pretreatment prior to the alkaline peroxide application at the refiner.

Conventionally the inclusion of chemicals such as silicates prior to the refiner leads to a situation where scale forms on the processing equipment. The refiner area itself also can suffer due to the formation of silicate precipitates, especially in processing softwoods, which can lead to a glassing of the refiner plates.

The application of chemicals at a point downstream of the refiner has also been proposed. However these proposals did not encompass the use of chemical pretreatment or conditioning of the chips. In addition such downstream chemical addition appeared incompatible with high pressure refining conditions.

SUMMARY OF THE INVENTION

The present invention is directed to the introduction of chemicals to lignocellulosic material immediately after refining in order to achieve, among other things, a comparable bleaching efficiency as when applying chemicals at locations upstream of and/or at the refiner.

The introduction of chemicals downstream of the refiner, wherein the refiner may be a primary, secondary and/or tertiary refiner, is utilized with the concept of applying chemicals such as alkaline peroxide pre-treatment to lignocellulosic material before refining. Preferably, the refiner has a highly pressurized case, for achieving the known benefits of high pressure refining.

The introduction of chemicals downstream of the refiner according to the invention may alternatively be utilized with the process referred to herein as P-RC (Preconditioning followed by Refiner Chemical treatment) for APMP, which combines the concept of applying chemicals such as alkaline peroxide as a pretreatment to lignocellulosic feed material before primary refining with the concept of applying chemicals such as alkaline peroxide at the primary refiner.

The preferred embodiment of the invention includes applying more than one-third of total alkaline peroxide (and/or other chemicals known in the art to bleach or otherwise process lignocellulosic material into pulp or precursors of pulp) at or near the blow valve in the post refiner intermediate line, in combination with chemical addition at the refiner and chemical impregnation of the chips upstream of the refiner, to yield a more energy efficient process and to allow a more efficient bleaching than the application of all the chemicals before discharge from the refiner.

A significant benefit of the invention is better chemical efficiency, by moving a greater number of chemical reactions downstream relative to conventional techniques, resulting from the relatively heavier or more intense addition of chemicals and/or chemical stabilizers at the post refiner blow line.

A further benefit of the invention is the reduction in the detrimental effects of the high temperature and/or other conditions prior to and during high pressure primary refining, which are known to influence pulp brightness and development.

Another benefit of the invention as implemented in a high-pressure system, is the recovery of more and higher quality of steam and/or heat than in other types of P-RC APMP systems, where the primary refiner is either completely atmospheric or atmospheric at the inlet.

BRIEF DESCRIPTION OF THE DRAWINGS

The invention will be better understood by reference to the accompanying drawings in which:

FIG. 1A is a block diagram depicting steps of transferring lignocellulosic material to a refiner having a casing at atmospheric pressure, with discharge at atmospheric pressure.

FIG. 1B is a block diagram depicting steps of transferring lignocellulosic material to a refiner having a pressurized casing with pressurized discharge.

FIG. 1C is a block diagram depicting steps of transferring primary pulp produced in the refiner with a casing at atmospheric pressure, to a high consistency tower via a transfer device.

FIG. 1D is a block diagram depicting steps of transferring primary pulp produced in the refiner with a casing at atmospheric pressure directly to a high consistency tower.

FIG. 1E is a block diagram depicting steps of transferring primary pulp produced in the refiner with a pressurized casing, to a high consistency tower via a transport device.

FIG. 1F is a block diagram consistent with an embodiment of the invention, depicting steps of transferring primary pulp produced in the refiner with a pressurized casing to a high consistency tower.

FIG. 2 is a table comparing P-RC with two prior art processes.

FIG. 9 is a comparative table of atmospheric versus pressurized casing processing of aspen wood chips according to P-RC.

FIG. 10 is a comparative table of atmospheric versus pressurized casing processing of birch wood chips according to P-RC.

FIG. 15 is a comparative table of refiner eye versus blow line chemical addition processing of birch and maple wood chips according to the invention.

FIG. 16 is a comparative table of refiner eye versus blow line chemical addition processing of spruce and red pine wood chips according to the invention.

FIG. 17 is a comparative table of refiner eye versus blow line chemical addition processing wood chips at higher pressure according to the invention.

DETAILED DESCRIPTION OF THE INVENTION

Figure 1:
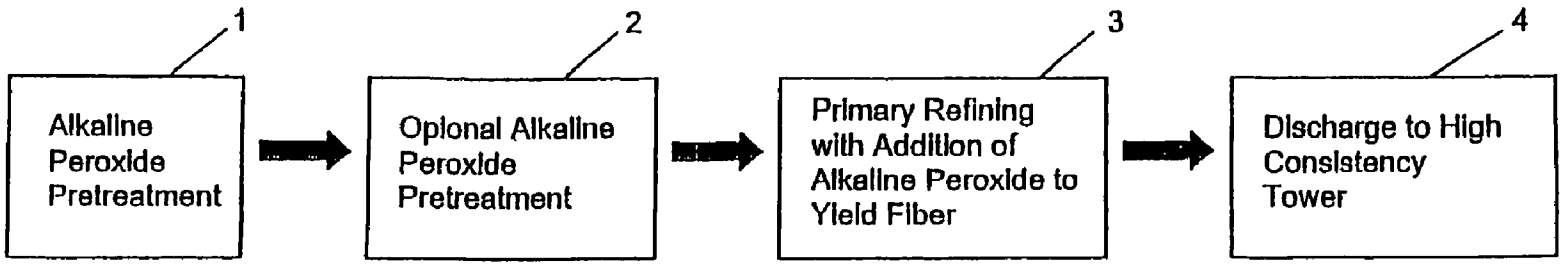
FIG. 1 is a block diagram depicting the general P-RC APMP process.

FIG. 1 presents a simplified process flow diagram of the P-RC alkaline peroxide mechanical pulping (APMP) process. The P-RC process generally applies alkaline peroxide chemicals at chip pretreatment/chip impregnation step(s)/stage(s) 1, 2 and as the material is fed to the primary refiner 3.

The preconditioning step(s) as implemented in stages 1 and 2 of FIG. 1, preferably include one or two atmospheric compression devices, such as screw presses. Chip material is fed through an inlet, and passes through at least one compression region and at least one expansion region, and is discharged. A chemically active solution (pretreatment solution) is added to the material, typically while decompressing or decompressed at or near the discharge to facilitate penetration of the solution into the material.

The refining step 3 may include a primary refiner of conventional size, configuration, and operating conditions as known for chemi-mechanical pulping. Depending on such factors as whether chemicals are to be added and what types of chemicals if any are to be added the size, configuration, and operating of the refiner can be tailored so as to not expose the chemicals to excessive temperature or time-temperature combination. In one embodiment of the invention the pressure can be within a range of about 15 psi to pressures greater than 45 psi. Any chemicals added at the refiner will be referred to as the refiner solution.

Figure 11:
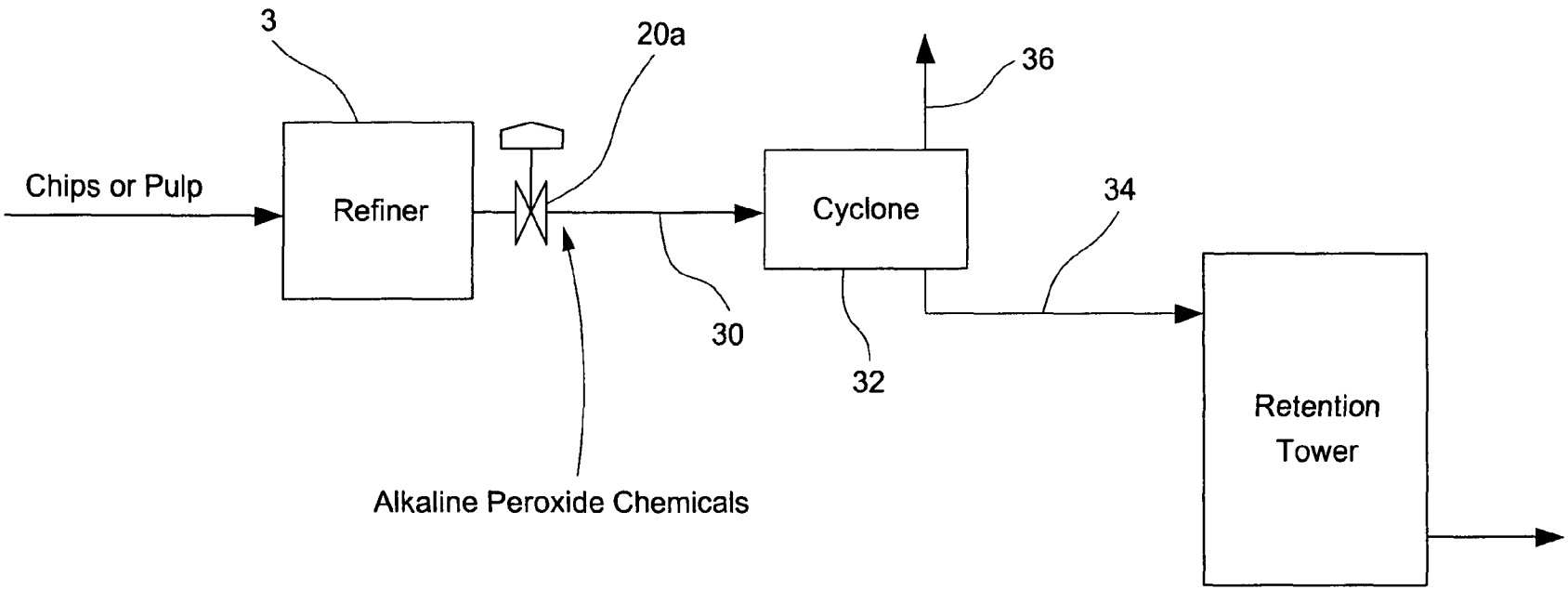
FIG. 11 is a block diagram consistent with an embodiment of the invention, depicting steps of transferring primary pulp produced in a refiner with a pressurized casing to a retention tower with a chemical addition in the intermediate line following the control valve.
Figure 12:
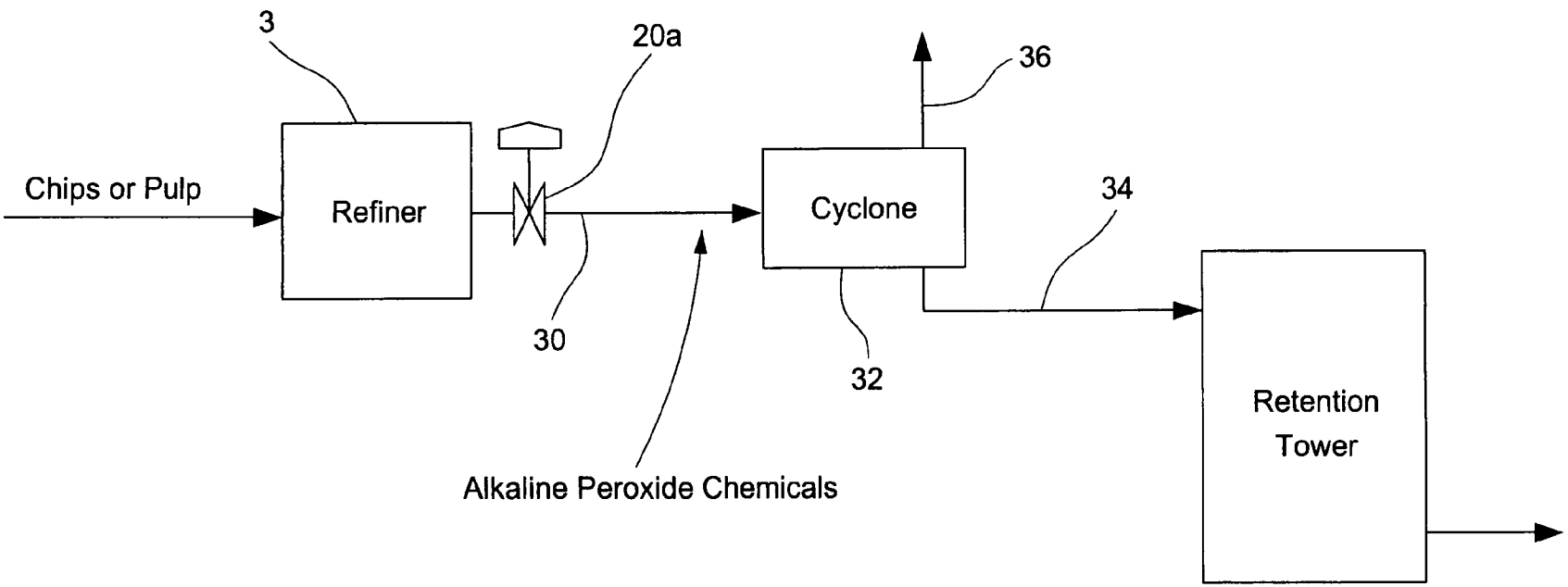
FIG. 12 is a block diagram consistent with an embodiment of the invention, depicting steps of transferring primary pulp produced in the refiner with a pressurized casing to a retention tower with an alkaline peroxide chemical addition in the intermediate line prior to the inlet of the separator.
Figure 13:
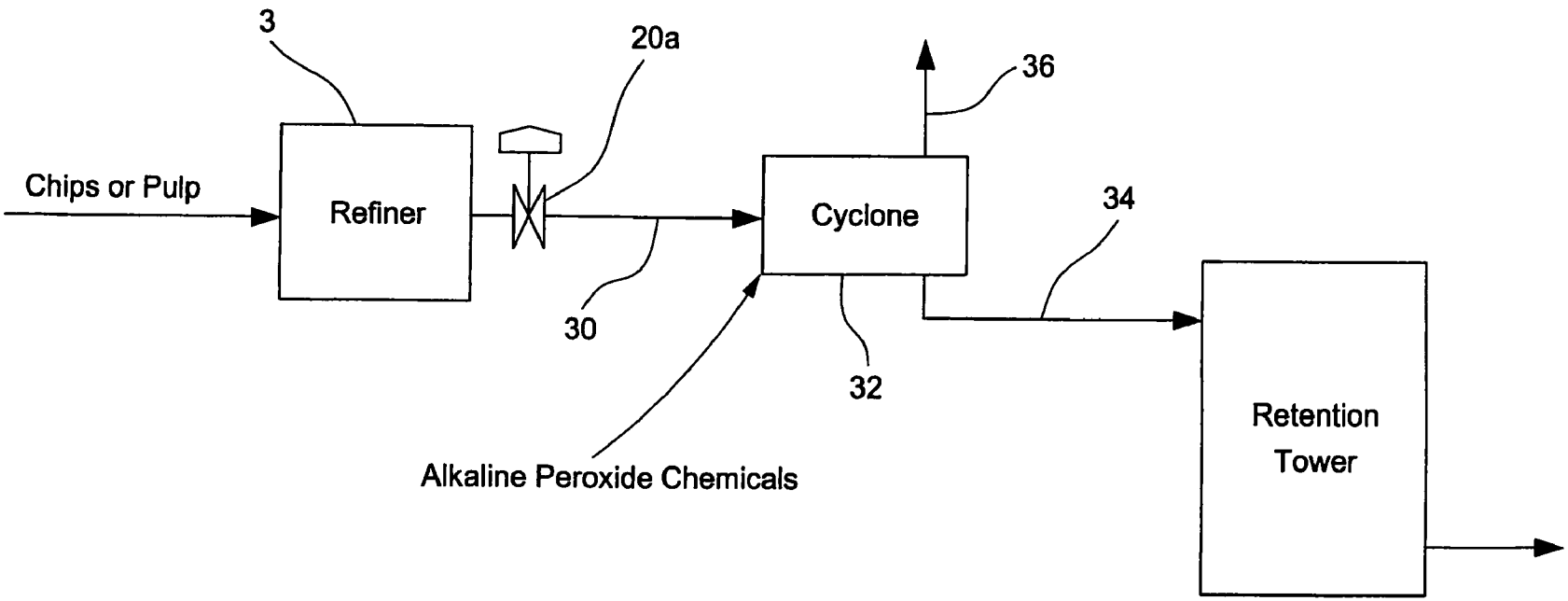
FIG. 13 is a block diagram consistent with an embodiment of the invention, depicting steps of transferring primary pulp produced in the refiner with a pressurized casing to a retention tower with an alkaline peroxide chemical addition in the intermediate line at the separator.
Figure 14:
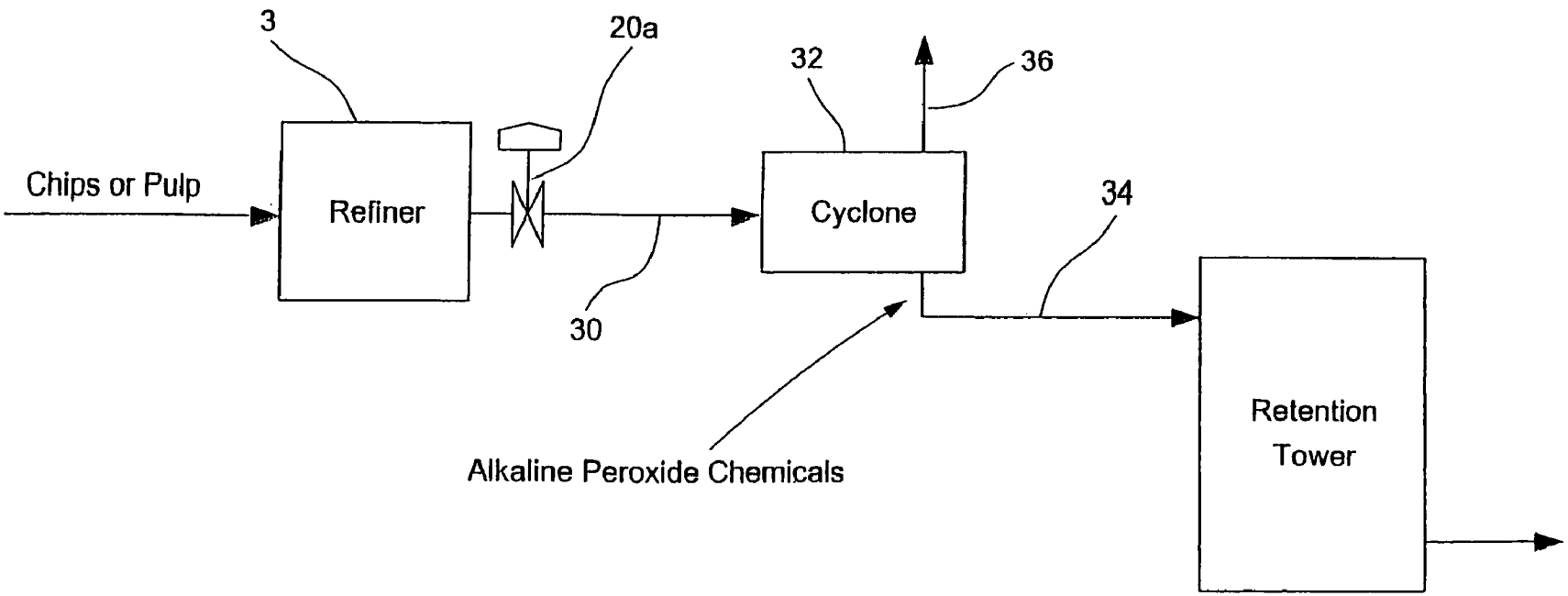
FIG. 14 is a block diagram consistent with an embodiment of the invention, depicting steps of transferring primary pulp produced in the refiner with a pressurized casing to a retention tower with an alkaline peroxide chemical addition in the intermediate line at the separator discharge.
Figure 18:
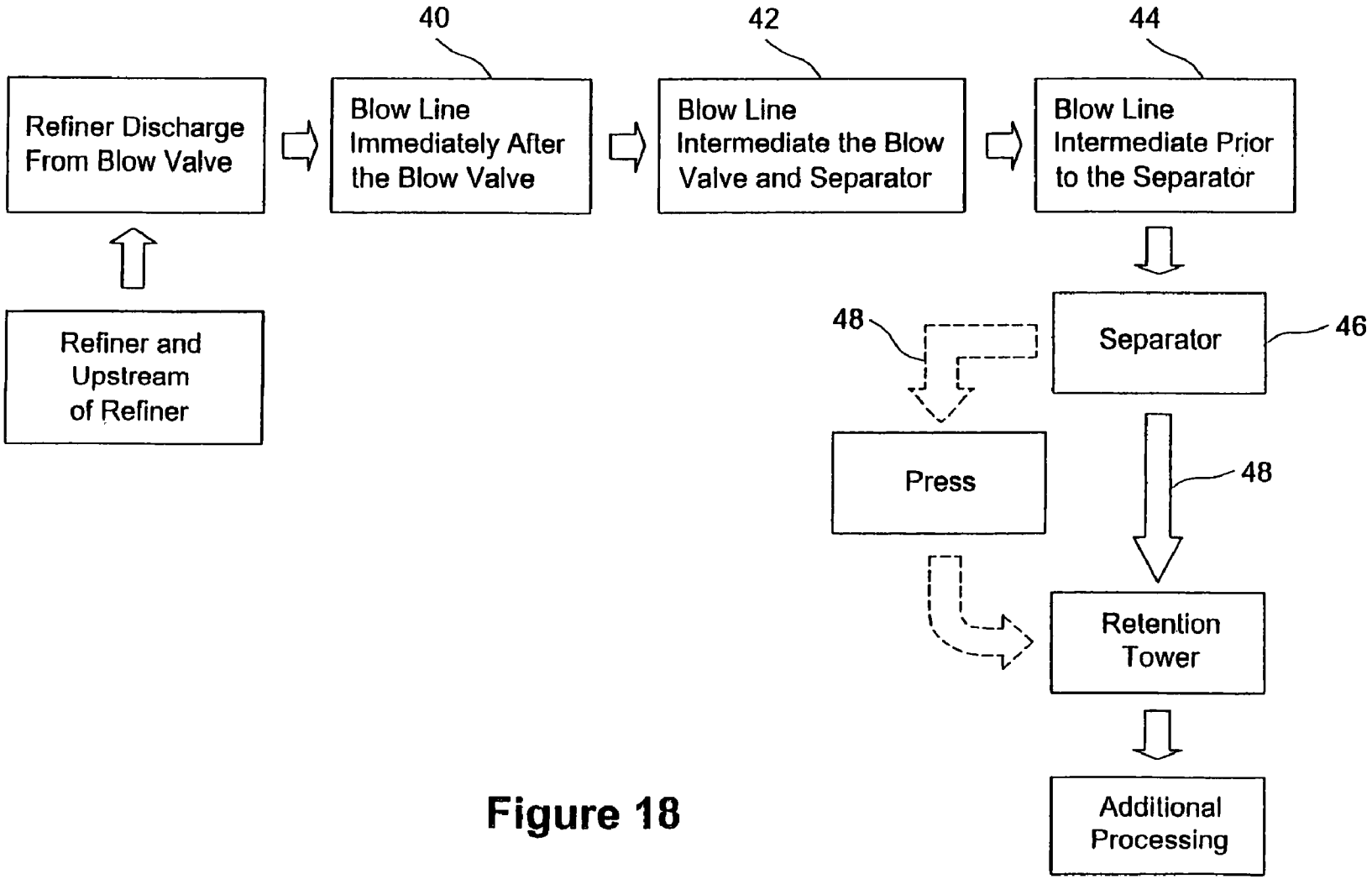
FIG. 18 is a block diagram consistent with an embodiment of the invention, depicting steps of transferring pulp produced in a pressurized refiner via a intermediate line to a tower.

Steps implemented following the primary refining, may have a level of chemical presence carried downstream from the refiner or other upstream processing. In one embodiment of the invention, the post refining chemical environment is modified by an addition or additions of a intermediate line solution or solutions to the intermediate line. The intermediate line is located between the refiner and the retention tower. For instance, as shown in FIG. 11, alkaline peroxide solution is applied to pulp in the intermediate line, at the blow line 30, after exposure to and discharge from the refiner. The chemicals may be applied at a point or points along and about the blow line 30. The blow line 30 may extend between the blow valve and a separator of the intermediate line. As shown in FIG. 18, the chemicals may also be applied in the intermediate line immediately after the blow valve 40, between the blow valve and the separator 42 immediately prior to separator 44, at the separator 46 and/or immediately after the separator 48. The separator, for instance a cyclone, may operate to separate steam/heat/liquid or combinations of those items from the pulp. Prior to entry into the separator the pulp may have a consistency of about 20% to about 60% and a temperature of about 80° C. to about 155° C.

Injection of the chemicals at a intermediate line location or locations may be made through simple orifices in the intermediate line and/or by the use of injectors, such as nozzles, associated with the line. The nozzles can be associated with the intermediate line in various ways along and about the intermediate line to desirably control the chemical addition. The control can be dependent, for example, on the effect that the additions have with regard to the bleaching process and/or conditioning process. Chemical profiles within the pulp flow can thus be modified or maintained by, for example, injection sequencing, flow rate, composition, and/or duration. Other variables such as the depth of injector intrusion into the flow path, injector angle, injector orifice configuration, and other properties of the injector installation may be modified to achieve a desired result. Chemical introduction may be modified by varying the introduction location based on the pressure used in refining. For instance, alkaline peroxide chemicals may be introduced immediately (from less than a few inches to a few feet) after the blow valve, especially in low pressure refining where the pressure is less than about 45 psi. The alkaline peroxide chemicals may also be introduced immediately before the cyclone (from less than a few inches to a few feet) after the blow valve, especially in high pressure refining where pressures higher than 45 psi are used. In other cases the alkaline peroxide chemicals may be introduced intermediate the cyclone and the blow valve, or even at the cyclone.

The refiner may be primary, secondary, and/or tertiary, with a pressurized casing or fully pressurized from preheater to refiner discharge. The pressure in the refiner aids in expelling the pulp from the refiner during discharge. The discharge can be modified or controlled by, e.g., the blow valve. The pressure assisted discharge of the pulp into the intermediate line can result in the pulp having a residence time of a few seconds to minutes in portions of the intermediate line. The pulp can achieve high velocities and experience significant turbulence as it flows through the intermediate line. These conditions enhance the mixing between the chemicals and the pulp. The intensive turbulence and a high temperature gradient in the pulp stream may also assist in transferring the chemicals to individual pulp fibers as well into the fiber wall.

As an illustrative example, the pulp may be about 100° C. or higher, and the chemical liquor may be 40° C. or lower. The intermediate line solution may preferably be in the range of about 10° C. to about 25° C. but can be up to 80° C. The application of alkaline peroxide chemicals at the intermediate line reduces the exposure time of the alkaline peroxide chemicals to high temperature, especially when elevated temperature and/or pressure is present at refining. This post refining addition to the pulp flow through injection proximity, facilitates an easier stabilization and an increased efficacy of the peroxide. The use of the invention in an intermediate line with a superatmospheric refiner system also can result in the enhanced or modified recovery of steam/heat/liquid from the pulp. Such steam may be diverted away through a steam pipe 36. These features also allow for the production of high-freeness pulps with low shives content, since it is well known in the industry that the higher refining pressure tends to produce lower shives, or cleaner pulp. In some cases a press may be included in addition to or in place of the cyclone 32. The press could allow for an increase in steam/heat/liquid recovery from the pulp.

In one embodiment of the invention the optimizing process to influence peroxide efficiency and brightness development can be accomplished when the primary refining is fully pressurized. In one particular configuration this may be referred to as P-RC APTMP, which differs from other P-RC APMP configurations where the primary refiner is operated either under completely atmospheric pressure, or with atmospheric pressure at the inlet and low pressure at the casing.

FIGS. 1A through 1F present various examples of a P-RC 20 process of the type generally shown in FIG. 1. For example, FIGS. 1A and B show that after the material is pretreated at 1 and/or 2, addition of the solution to the lignocellulosic material may more specifically occur at a cross conveyer 10, downstream of the screw press and near refiner 3, or at the refiner itself, e.g., the ribbon feeder 12, the inlet eye of the refiner disc 14, and/or at the inlet zone of the plates on the refiner disc 16. As used herein, chemical addition "as the material is fed to the refiner", encompasses the locations 10, 12, 14, and 16. The refiner in a P-RC process may have an atmospheric casing 3A or an overpressure casing 3B, but the inlet to the refiner would normally be at atmospheric pressure. The discharge from a pressurized casing 20*a* of primary pulp may be through a blow valve or similar device, and discharge from an atmospheric casing 20 may be by gravity drop or the like. The discharge from the refiner will, in any event, directly or indirectly go to a high consistency-bleaching tower 24 of any type known in the art (but subject to temperature control).

In one embodiment of the invention the pretreatment solutions, the refiner solutions (if present), and the intermediate line solutions act chemically on the lignocellulosic material. It may be advantageous, depending on the lignocellulosic material and the processing equipment, to modify the chemical exposure profile of the material to the chemical agents in order to optimize the process, and/or eliminate or reduce unwanted chemical effects or degradation. Such chemical profile modification may be accomplished by sequential chemical additions throughout the process, and can be combined with other variable conditions such as temperature, concentration, pressure, and duration to further enhance the desired effect.

Lignocellulosic material processed using the P-RC process can be discharged 4 from the primary refiner casing (either atmospheric discharge 20 or overpressure discharge 20*a*), as a primary pulp having a measurable freeness and could properly be called a pulp able to form a handsheet. As shown in FIGS. 1C and D, atmospheric discharge from the refiner could pass via a transfer device 22 such as a transfer screw, to the tower 24, or more directly 28 via a chute or the like. As shown in FIGS. 1E and F, with a pressurized casing the refined pulp would typically be discharged through a blow valve and delivered either directly or indirectly to the tower. Optionally, as shown in FIGS. 1C and E, the bleached pulp exiting the tower can be further processed in, e.g., a secondary refiner. The high consistency retention tower 24 allows the chemical bleaching reactions carried over from upstream of the tower to continue.

In one embodiment of the invention, for example as shown in FIG. 18, the discharge from the blow valve may be delivered indirectly to a retention tower through a separator and/or a press.

The presence of an ample amount of the alkaline peroxide chemicals in the primary refiner (e.g., as by shifting a large proportion of the chemical reactions to the refiner chemical treatment stage) improves efficiency. This is because variations in chip forms and quality, in addition to the natural heterogeneity of wood chips and fibers, often make it difficult, if not impossible, to achieve a good chemical distribution in the chip pretreatment/impregnation stage(s). In these situations, the mixing action at the primary refiner helps to promote chemical distribution, and hence, improves the chemical efficiency.

In accord with one embodiment of the invention, the addition of chemicals into the post refining intermediate line allows, for example, the use of a pressurized refiner and higher temperatures in refining. Addition of chemicals to the intermediate line at, for example, the blow line provides for a fast, and more direct, distribution of chemicals such as peroxide to the chromophore sites for efficient bleaching. This efficiency is achieved because the targeted peroxide reactions are carried out at the reaction site of interest quickly without lengthy exposure to the more heterogeneous environment present in previous portions of the process. Conventionally the temperature at the inlet between the plates of a refiner pushes the chromophore removal and hemicellulose alkali reactions so fast that that pH is lowered prematurely. Using the post refiner intermediate line as the location for chemical mixing according to an aspect of the present invention, distributes the chemicals fast enough, to compete favorably against and counter to a significant extent, the elevated temperature of the pulp. Such elevated temperature can be, for example, from about 80° C. to about 155° C.

In one embodiment of the invention, the pulp can be maintained in an interstage high consistency retention tower. The pulp in the high consistency retention tower may have a consistency of about 20% to a consistency of about 40% consistency, with a preferable consistency of about 30%. The temperature of the pulp in the high consistency retention tower may be from about 60° C. to about 95° C. The pulp can be held in the retention tower from about 30 minutes to more than 2 hours depending on the chemical reaction needed for chemical treatment. The maintenance conditions include but are not limited to temperature, pressure, pH, chemical concentration, solids concentration, and time, that allow for conditioning and/or bleaching of the pulp to continue and limit the degradation of the bleaching agent through reactions that are extraneous to the bleaching of the pulp. Such extraneous reactions may be non-productive, inefficient, and/or harmful to the bleaching of the pulp. Control of some and/or all of the conditions may or may not be needed depending on e.g., the type and condition of the lignocellulosic material used in the process, and the type, size and operating environment of the equipment itself. For example, conditions of temperature may be modified throughout the process by the addition of the chemicals, pressurized gas, and other heating or cooling methods. Temperature modifying means may be employed during transfer of the primary pulp 22 by using a mixing screw with water added while the pulp is mixed and transferred to the tower. The temperature of the primary pulp may also be thermally adjusted within the tower if the primary pulp is discharged directly to the tower 28, by means known in the art. For example, the pulp may be thermally adjusted through addition of liquids or gases, and/or through use of heat transfer components such as tubing, tower jacketing, etc.

As used herein, the term "control" should be understood as including both active and passive techniques. Thus, control could be implemented by a static hardware configuration or by continually measuring one or more process parameters and controlling one or more process variables.

The chemical conditions present anywhere in the inventive process may be modified by additives to prevent extraneous degradation. This modification may be made at, by way of example, the pretreatment step(s) 1 and/or 2, the cross conveyer 10, the ribbon feeder 12, the inlet eye of the refiner disc 14, the plates of the refiner disc 16, the blow valve 20*a*, the blow line 30, the separator, 32, and/or after the separator. An example of stabilizers would be chelation agents. A chelation agent refers to a compound that has an ability to form complexes, so called chelates, with metals occurring in the lignocellulosic material, and primary pulp. Such metals may include monovalent metals sodium and potassium, earth-alkali divalent metals calcium, magnesium and barium, and heavy metals such as iron, copper and manganese. The metal ions retained in the material as it is processed makes the bleaching by oxygen chemicals (such as hydrogen peroxide) less effective, and results in excess chemical consumption as well as other problems well known in the art. In order to reduce or eliminate the effect of these metal ions on the process, chelants such as for example diethylene triamine pentaacetic acid (DTPA), ethylene diamine tetraacetic acid (EDTA) and nitriletriacetic acid (NTA) may be used. These and other chelation agents known in the art may be used alone or in combination as needed or desired depending on process conditions. In addition, silicates and sulfates as examples may also be used advantageously as stabilizers as well as serving other functions well known in the art.

Further embodiments and aspects of the invention will be apparent from the examples and description set forth below.

ILLUSTRATIVE EXAMPLES

Example Set A

Several general series of pilot plant processes are illustrated in the following examples. The materials and conditions for the following examples, unless specified otherwise are:

Wood: A blend of 50% aspen and 50% basswood was used in this study. The aspen woods had rotten centers, which made it more difficult to bleach than normally expected. The woods were all from Wisconsin USA, and debarked, chipped and screened before further processing.

Chemical Impregnation: Chips were pre-steamed first for 10 minutes, and then pressed using an Andritz 560GS Impressafiner at 4:1 compression ratio before impregnated with alkaline peroxide chemical liquor. The chemical liquor was introduced at the discharge of the press, and allowed for 30 minutes retention time before refining.

Refining: An Andritz 92 cm (36") Model 401 double disc atmospheric refiner at a conventional speed of 1200 rpm was used for all the refining processes. There was 15 minutes or more retention time between the primary and the secondary, and no dilution after the primary and before the secondary. The refining consistency was 20% at both the primary and the secondary.

Pulp Testing: Tappi Standards were used for all pulp testing except for freeness, which follows Canadian Standard Freeness (CSF) test methods.

In the first of three processes compared, all of the alkaline chemicals were applied, (3.3% total alkalinity, (TA), and 2.4% $H_2O_2$, together with 0.2% DTPA, 0.07% $MgSO_4$ and 3% $Na_2SiO_3$) at the chip impregnation (preconditioning or pretreatment) stage, (only one stage chip impregnation was applied), then refined at atmospheric pressure. This series was, therefore, named "Chip". The second series used approximately two thirds of the total alkaline peroxide chemicals, (or 2.4% TA, 1.6% $H_2O_2$, 0.08% DTPA, 0.04% $MgSO_4$ and 2.4% $Na_2SiO_3$), at the chip impregnation stage, and approximately one third of the total chemicals, (1.0% TA, 1.0% $H_2O_2$, 0.19% DTPA, 0.05% $MgSO_4$, and 0.9% $Na_2SiO_3$), at the eye of the primary refiner. It is labeled as "Chip+Refiner", and represents the invention. In the third series, labeled "Refiner", the chips were first pressed using the same chip press as the first two series, and then all the alkaline peroxide chemicals, (4.2% TA, 3.3% $H_2O_2$, 0.36% DTPA, 0.11% $MgSO_4$, 4.3% $Na_2SiO_3$), were applied at the eye of the primary refiner. In all the series, the pulp from the primary was allowed 15 minutes retention under cover in drums, (which gave a temperature about 80-90° C.), before the second stage refining. There was no interstage washing.

FIG. 2 summarizes some of the process conditions and results from each series. The pulps are all from second stage refining. In peroxide bleaching of mechanical pulps, a lower $TA/H_2O_2$ ratio is in general preferred under higher temperature to prevent, or to reduce the possibility of alkali darkening reaction. For this reason, as shown in Table 1, the lowest $TA/H_2O_2$ ratio, 1.27, was use for "Refiner" series, the second lowest, 1.31, for "Chip+Refiner" series, and the highest, 1.37, for "Chip" series. In "Refiner" series, a larger amount of TA charge (4.2%) was used to prevent pH from dropping too fast and too low during refining because of the high temperature and the heat generated from refining energy. Reasonable amounts of residual peroxide and pH were maintained in each of the series, FIG. 2.

As to the chemistry, the main difference between "Chip" and "Chip+Refiner" series is that the latter is more aggressive in moving more alkaline peroxide chemicals to the refiner chemical treatment stage.

Figure 3:
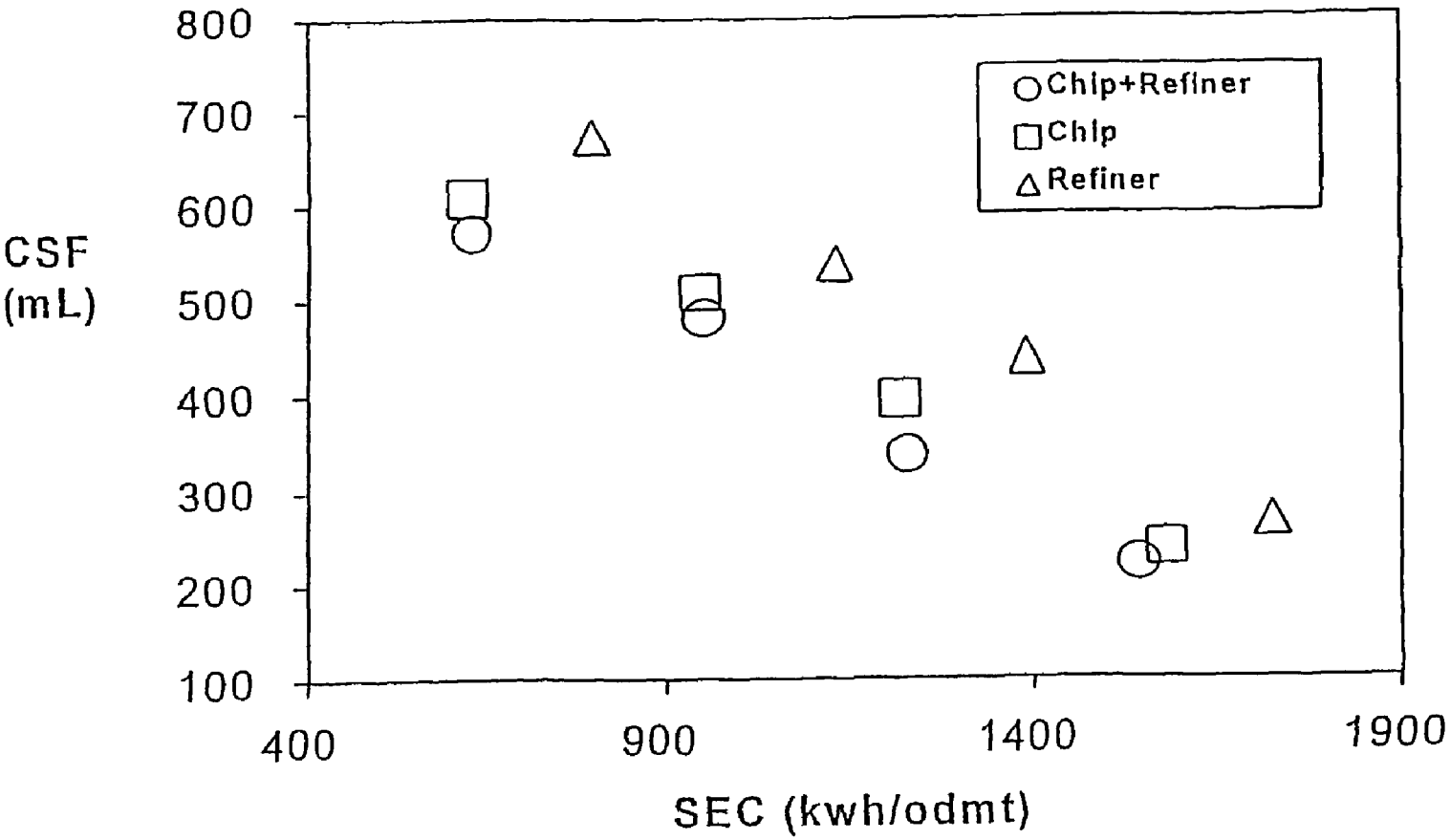
FIG. 3 is a graph of freeness as related to energy consumption for P-RC and two prior art processes.

Graphic presentation of the data gathered from pulp after secondary refining after different investigated processes are shown in FIGS. 3 through 8. FIG. 3 shows effects of the different chemical applications on pulp freeness development in relation to specific energy consumption (SEC), which includes energy consumed during chip pretreatment stage.

The "Chip+Refiner" series used slightly less SEC than the "Chip" series, but both series used, on average, approximately 200 kwh/odmt less SEC than the refiner bleaching series, "Refiner", even though the latter had more caustic chemicals applied than the first two series and has the same residual pH, 8.2, as "Chip+Refiner" series. It appears that adding the alkaline chemical under high temperature, at refiner eye, causes more alkali consumed on nonproductive, or side reactions that have little to do with pulp property development.

It should be pointed out that in a commercial operation, the SEC in general is lower than that observed at the lab for chemical mechanical pulping of hardwoods. The SEC values in FIG. 3, therefore, are better used for comparison purpose than for their absolute values.

Figure 4:
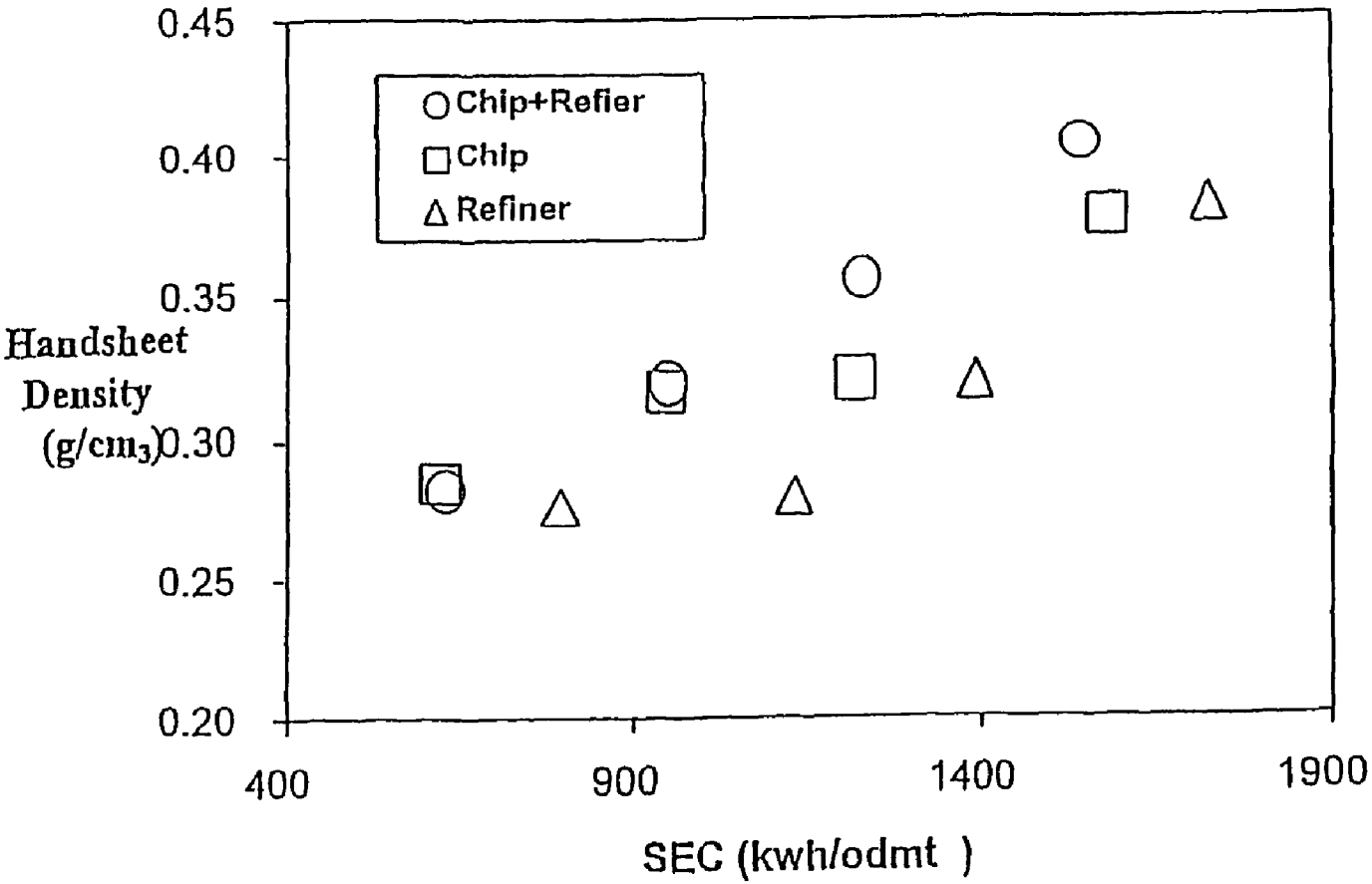
FIG. 4 is a graph of density as related to energy consumption for P-RC and two prior art processes.

Because many pulp properties, especially the strength properties, are dependent on handsheet density, this property was also analyzed under SEC, and results are shown in FIG. 4. In this case, the more aggressive refiner chemical treatment P-RC APMP series, "Chip+Refiner", had the best efficiency for handsheet density development, which was followed by "Chip" and "Refiner" series. These results demonstrate that in chemical mechanical pulping, process energy efficiency depends not only on how much but also on how the chemicals are applied.

Figure 5:
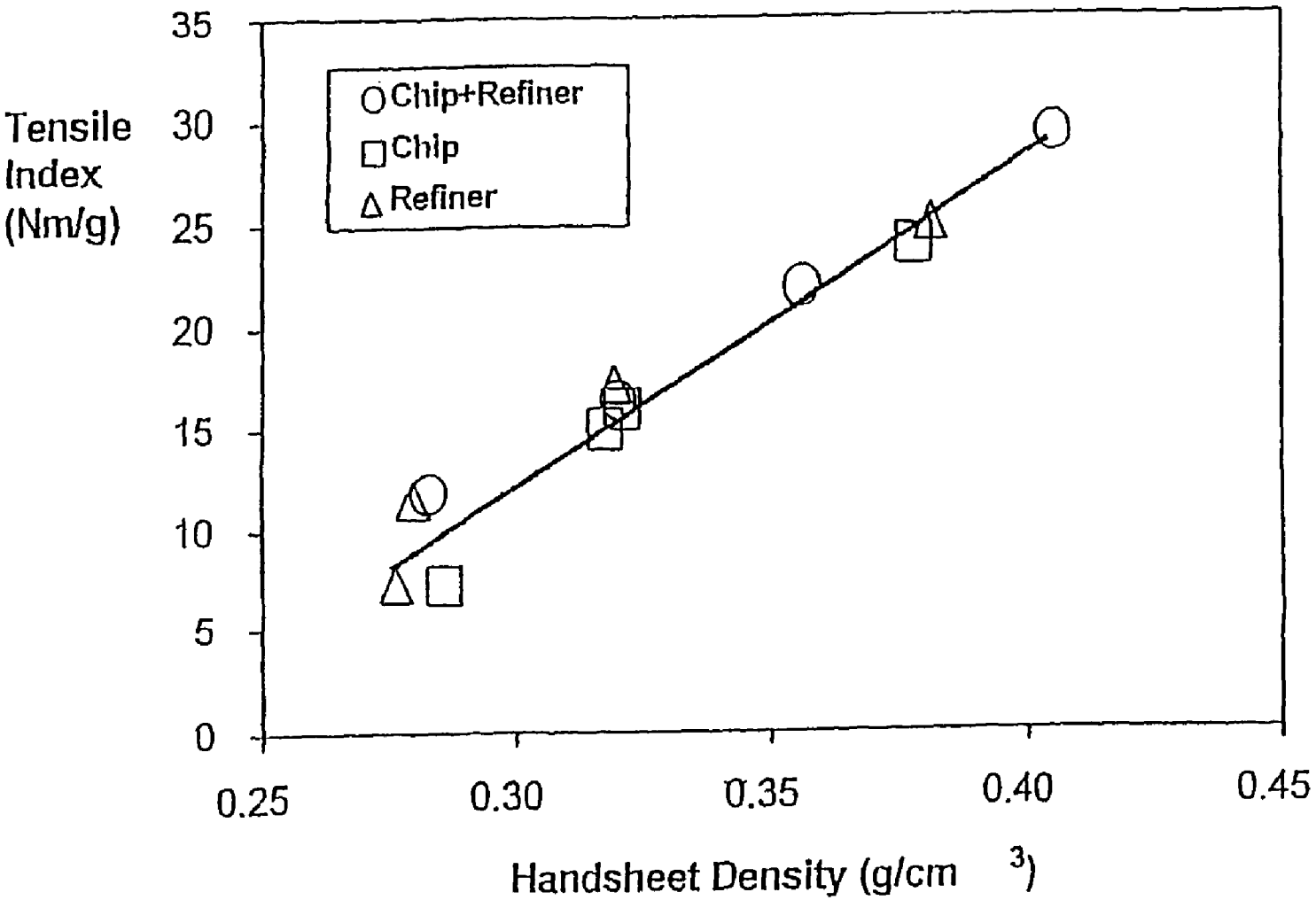
FIG. 5 is a graph of the tensile of tensile development for P-RC and two prior art processes.
Figure 6:
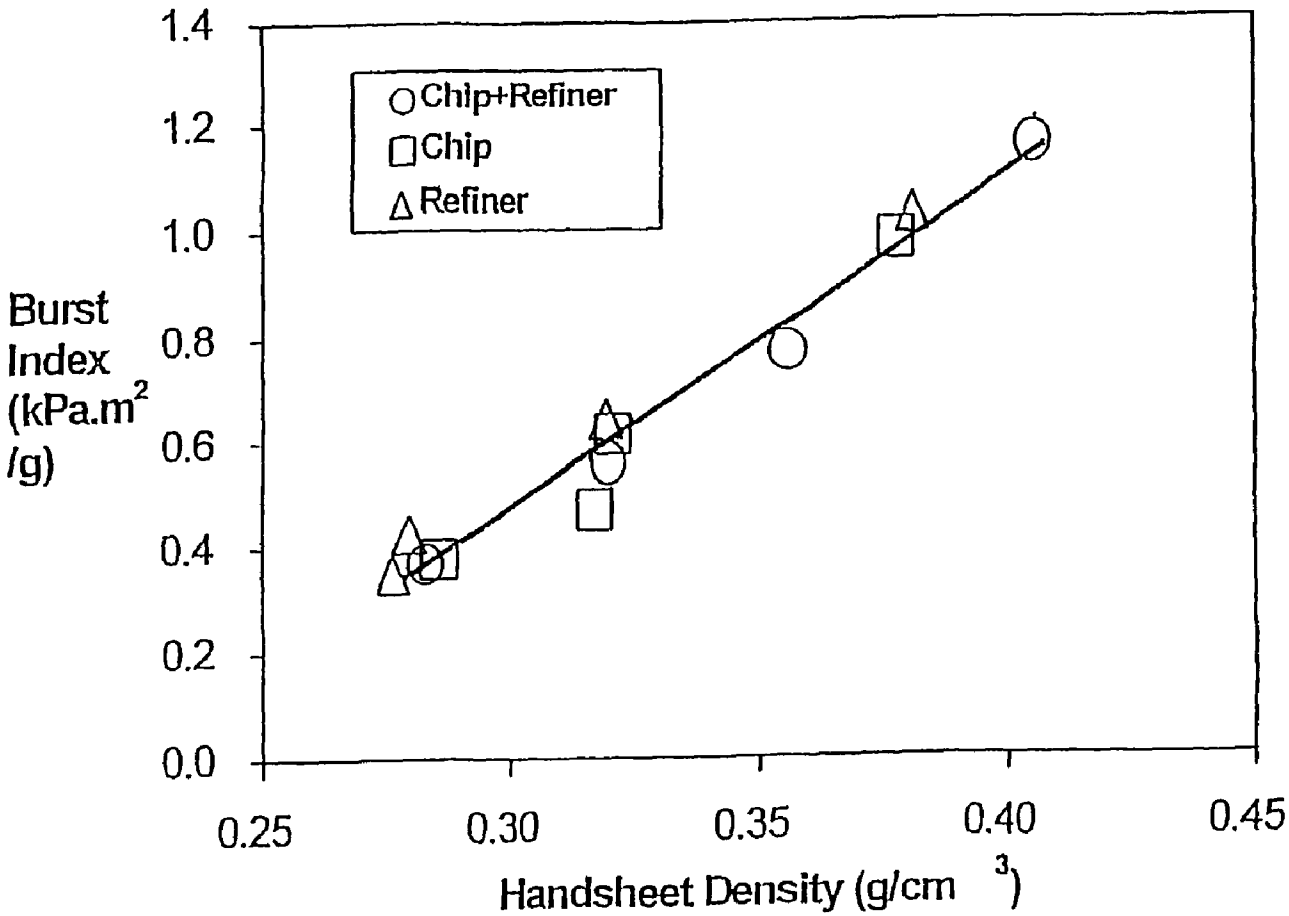
FIG. 6 is a graph of burst development for P-RC and two prior art processes.

As for pulp intrinsic property development, there was however, little difference among the three series, as illustrated in FIGS. 5 and 6, suggesting that as long as the chemicals are added before refining, the mechanism involved in fiber strength property development remains the same.

Figure 7:
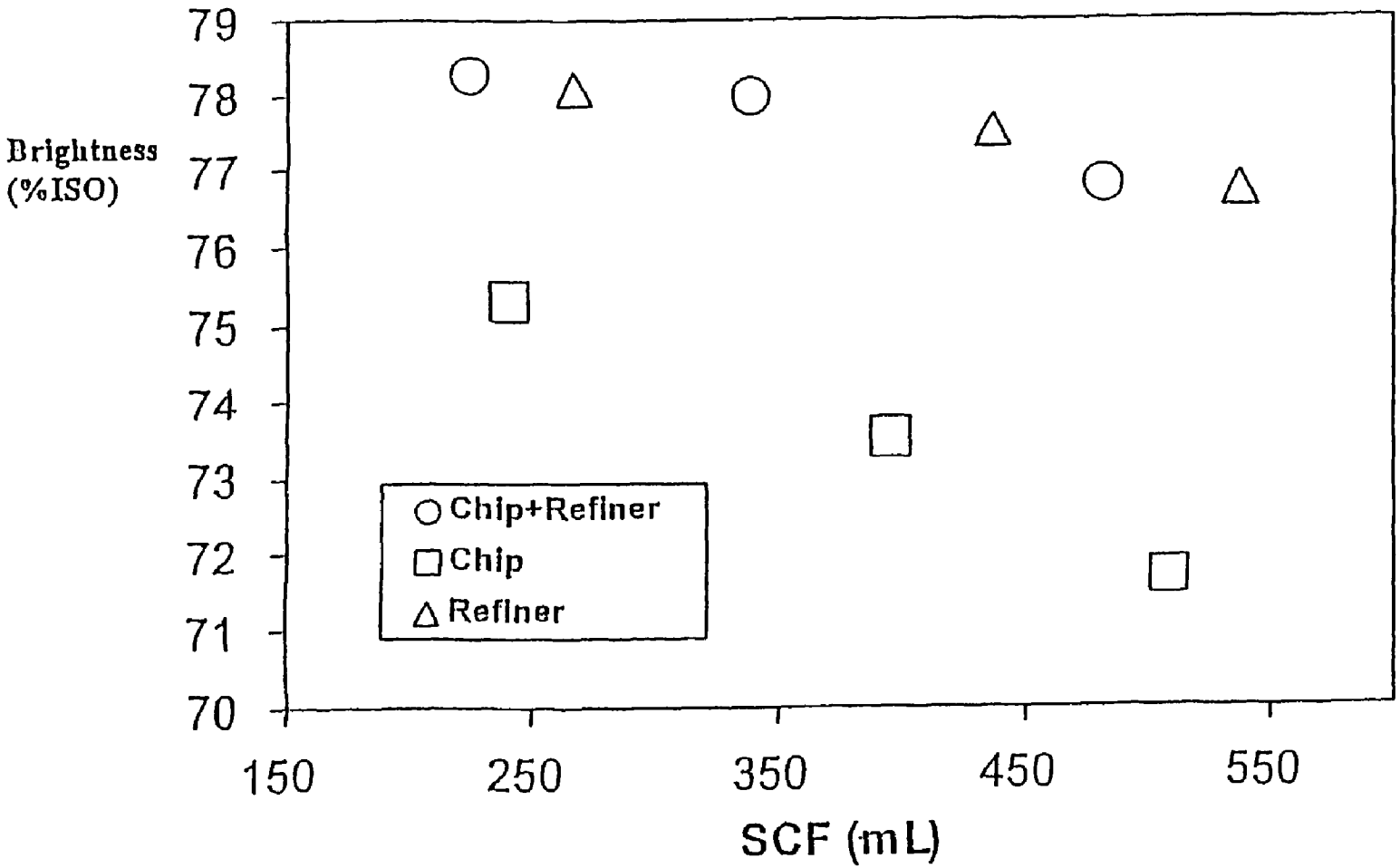
FIG. 7 is a graph of brightness development for P-RC and two prior art processes.

As for pulp optical property development, in mechanical pulping, pulp brightness is often freeness-dependent. FIG. 7 shows brightness at different freeness from each series. Of interest is that "Chip+Refiner" series had a similar brightness development as that of the "Refiner" series, even though the former used less amount of the bleaching chemicals, 2.6% $H_2O_2$/3.4% TA versus 3.3% $H_2O_2$/4.2% TA. Adding all of the chemicals at the impregnation stage, "Chip" series, showed also a less bleaching efficiency, 2 or more points lower, than that of "Chip+Refiner" series. This suggests that the bleaching efficiency is sensitive to how the chemicals are distributed between the chip impregnation and refining in P-RC APMP process. In this case, a compromise between adding all of the chemicals at chip impregnation or at eye of refiner appears to be the most efficient in bleaching and peroxide consumption.

Figure 8:
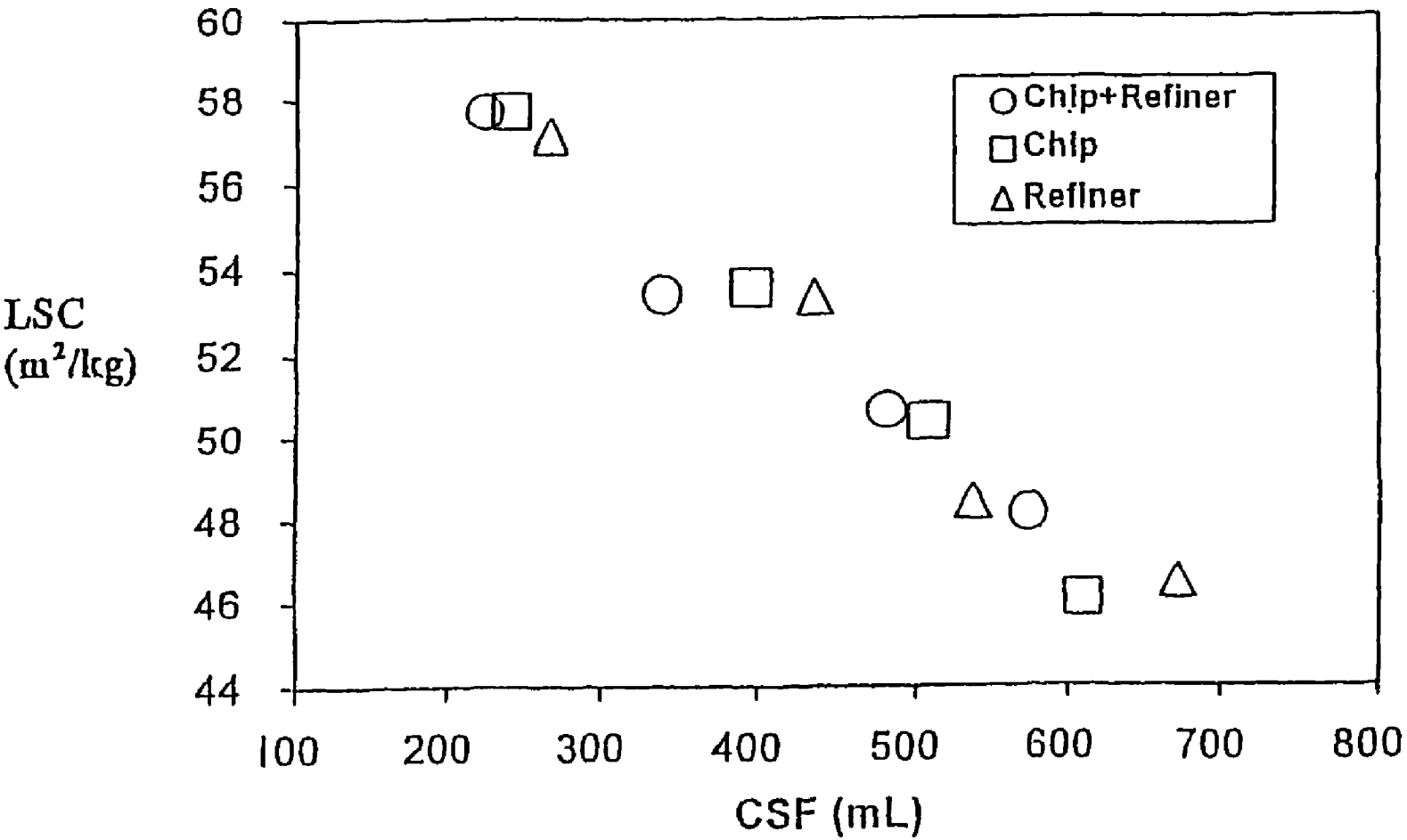
FIG. 8 is a graph of the light scattering coefficient of the pulp as a function of freeness for P-RC and two prior art processes.

FIG. 8 shows that there was no difference in light scattering property development in all the series studied, suggest the pulp surface development mechanism also remain the same as long as the chemicals are added before refining.

Example Set B

The below examples illustrate a different refining configuration where the primary refiner was maintained at a negligible gauge pressure at the inlet and a low pressure (approximately 140 kPa) at the casing. Advantages of this configuration include:

1) better steam handling at the refiner discharge, especially for high capacity refiners (300 t/d or higher);

2) ease of transfer primary pulp from the refiner to the interstage high consistency (HC) tower;

3) a potential to use some of the steam generated from the primary refining (by using a cyclone to separate steam and pulp fiber);

4) ease of converting existing TMP systems into a P-RC APMP process.

These examples show that running the primary refiner at a low pressure (140 kPa) in the casing and atmospheric at the inlet can give similar bleaching efficiency as that of atmospheric at both the inlet and the casing. Temperatures at the inlet and between the plates in the primary refiner may push the chromophore removal and hemicellulose alkali hydrolysis reactions fast enough that pH was lowered considerably before the pulp reaches the casing out off the refiner plates. The pulps at the cyclone discharge from the primary refiner were measured in the examples below to have pH of 9.3-9.7, at which peroxide is easy to stabilize even under the high temperatures (80-90° C.) observed.

The materials and conditions for the following examples below were as follows:

Wood: Aspen and birch chips from a commercial pulp mill in eastern Canada were used in this study.

Chip Impregnation: A conventional pilot chip impregnation system was used in this study. In all the P-RC APMP runs studied, only DTPA was used in the first stage of chip impregnation. The chips were then impregnated with alkaline peroxide (AP) chemicals at second stage impregnation. The AP treated chips were then allowed for 30 to 45 minutes' retention (without steaming) before being refined.

Atmospheric Refiner System: Andritz 36" diameter (92 cm) double disc 401 system is typically used for conventional P-RC APMP process investigations. This system consists of an open metering belt, an incline twin-screw feeder, the refiner and an open belt discharge. The system is used for both primary and later stages of refining. When used for the primary, the pulp discharged were collected in drums and kept under cover to maintain a high temperature (typically 80 to 90° C.) for a certain period of time.

Pressurized Refiner System: An Andritz single disc 36" diameter (92 cm) pressurized system was modified for atmospheric inlet/pressurized casing configuration. The original refiner system has all the standard features of a conventional TMP system. In order to run the system with atmospheric pressure at the inlet, a valve was placed on top of the vertical steaming tube and was kept open during refining. During the trial, the plug screw feeder (PSF) was run at 50 rpm (normal speed for TMP is 10 to 20 rpm) to ensure the chemical impregnated chips were not compressed. The AP impregnated chips were placed in a chip bin, which discharged the chips into a blower. The chips were then blown to a cyclone and discharged to a conveyor, which feeds the PSF. The chips were then dropped into a vertical steam tube before being fed into the refiner. During refining, the primary refiner was controlled to have zero pressure at the inlet and 140 kPa in the casing. From the casing, the primary pulp was blown to a cyclone and discharged and collected in drums, and then treated similarly as in the atmospheric refining runs.

Pulp Tests: TAPPI standard was used for brightness tests. Peroxide residuals were measured using standard iodometric titration.

Running the primary refiner with pressurized casing and atmospheric inlet was compared with conventional atmospheric refining in P-RC APMP pulping of aspen and birch commercial wood chips. The results showed that both refining configurations gave similar bleaching efficiency. For some installations, using pressurized casing can significantly simplify the process, engineering and operation of P-RC APMP process.

FIG. 9 presents the chemical conditions used for P-RC APMP pulping of aspen, and brightness results from atmospheric and casing pressurized runs with the primary refiner. Applying similar AP chemical strategies in both cases, and having similar amounts of total chemical consumption (5.2 to 5.4% total alkali, TA, and 3.7 to 3.9% $H_2O_2$), both the atmospheric and the casing pressurized gave a similar brightness, achieving 84.2% ISO and 84.7% ISO respectively.

The residual pH (8.8-9.0) in both cases were slightly higher than ideal (approximately 7.0-8.5) and the $H_2O_2$ residual (1.5 to 2.0% on o.d. pulp) was also higher than normal (0.5 to 1.0%), suggesting that in both cases the pulp property could be further developed had the chemical treatments been further optimized.

It is worth pointing out that the bleaching efficiency shown in Table 1 (3.7 to 3.9% $H_2O_2$ and 5.2-5.4% TA consumption to reach 84.2 to 84.7% ISO brightness) is comparable to or better than bleaching efficiency normally observed in $H_2O_2$ bleaching of TMP or CTMP pulps from aspen.

20 FIG. 10 presents conditions and results from P-RC APMP pulping of the birch. This particular birch chips was slightly more difficult to bleach than the aspen. Using similar AP chemical strategies, the atmospheric and the pressurizing casing again gave similar bleaching efficiency: 3.1-3.2% TA and 3.4-3.6% $H_2O_2$ to reach 82.4 to 82.6% ISO brightness. In this case, the residual chemicals (0.1-0.2% TA, 0.5-0.6% $H_2O_2$ and pH of 8) were within ideal $H_2O_2$ bleaching conditions.

Example Set C

This example set shows, among other things, that when the chemical recipe and distributions are optimized, the alkali peroxide chemicals at refiner chemical treatment stage can be applied at the intermediate line in a pressurized refiner system to achieve similar bleaching efficiency as P-RC APMP with conventional atmospheric inlet pressure. Because the residence time is very short in a intermediate line, the same process may also be used in a high pressure refining system, for example a refining system operating at 4 bar or higher.

Wood

All the hardwoods (birch and maple) were received in chip form and mixed separately before being further processed. All the softwoods (spruce, pine and softwood blends) were received in log form, and debarked, chipped and mixed prior to further processing.

Chip Impregnation

The wood chips, unless otherwise specified, were impregnated twice with AP chemicals (consisting of sodium hydroxide (NaOH), hydrogen peroxide ($H_2O_2$), DTPA, Magnesium Sulfate ($MgSO_4$) and sodium silicate ($Na_2SiO_3$), utilizing an Andritz 560GS Impressafiner System. In some cases, the RT-Pressafiner was used at the first stage impregnation (steamed at 1.4 bar for 20 seconds before being pressed).

Refining

An Andritz 36" diameter (91 cm) single disc 36-1CP refiner system was used for all pressurized and atmospheric inlet/casing pressurized runs, and an Andritz 36" diameter (91 cm) double disc 401 system was used for all atmospheric refining runs. Typically, except where stated otherwise, the 401 refiner was used for all secondary and tertiary refining.

Process Description

The P-RC, (Preconditioning, following by Refiner Chemical treatment, where AP chemicals are distributed between chip pretreatment and refining stages), process was used in all trial runs. For the runs where AP chemicals were charged at the intermediate line, the pulp discharged from the blow line was covered under a plastic bag in drums to maintain a temperature of 85-95° C., depending specific refining energy used at the refiner, the chemical charges, and the nature of the raw materials.

Pulp Tests

Canadian Standard Freeness (CSF) was used for all freeness tests and standard Tappi methods were used for all optical property tests (brightness Tappi T2180M-83, light scattering, and light absorption coefficient Tappi T425 OM-86 (for handsheet Tappi 205 OM-88)).

FIG. 15 shows the results obtained by applying AP chemicals at either the refiner eye or the intermediate line during the refiner chemical (RC) treatment stage. Birch and maple woods were used in this example. For each wood species, some chemical pretreatment, (preconditioning), was applied on the chips. For birch the chips were treated with 0.3% DTPA at first stage impregnation, and then 0.2% $MgSO_4$, 4.4% Silicate, 2.8% TA, and 2.8% $H_2O_2$ at the second stage impregnation. For maple the chips were treated with 0.5% DTPA at first stage impregnation, and then 0.2% DTPA, 0.1% $MgSO_4$, 2.0% Silicate, 1.6% TA and 2.6% $H_2O_2$ at the second stage impregnation. The preconditioned chips then received a similar amount of AP chemicals during refiner chemical (RC) treatment stage, but at different points: one at the refiner eye before refining, and another at the intermediate line immediately after refining.

For the birch, both series (A1 and A2) used a total of 5.2% $H_2O_2$ and 4.6% total alkali (TA), and had a similar amount of $H_2O_2$ residuals (1.0%-1.1%) and final pH (8.9-9.0). The final pH's were relatively high, indicating that a higher brightness would be achieved if a longer retention time was used. The series from AP addition at the refiner eye (A1) had a similar brightness to samples where AP chemicals were added at the intermediate line, A2, for example, 84.8 versus 84.2% ISO. The slight difference in the brightness was likely, at least in part, due to the slight difference in their freeness, 285 mL for the former case and 315 ml for the latter. In terms of chemistry, both series gave similar light absorption coefficients, 0.27 $m^2$/kg from the former and 0.25 $m^2$/kg from the latter.

In the case of the maple wood, adding AP chemicals at intermediate line, A4, actually gave a higher brightness, 81.9% ISO, than that, 79.2% ISO, from applying the AP chemicals at refiner eye, A3. The difference in this case was a combination of the lower freeness, (295 vs. 320 mL), and the lower light absorption coefficient, (0.32 vs. 0.5 $m^2$/kg), of the former.

Softwoods, namely spruce and red pine, were also investigated in to examine effects of different AP chemical applications. FIG. 16 summarizes the results, and shows again that similar brightness was achieved by applying AP chemicals at either the refiner eye or the intermediate line. In the case of spruce the chips were first impregnated with 0.3% DTPA, 0.05% $MgSO_4$, 0.7% Silicate, 0.2% TA and 0.5% $H_2O_2$, and then 0.1% DTPA, 0.08% $MgSO_4$, 1.8% Silicate, 1.4% TA and 1.9% $H_2O_2$ at second stage impregnation. In the case of red pine the chips were treated with 0.4% TA, 0.5% $H_2O_2$, 0.2% DTPA, 0.04% $MgSO_4$ and 0.5% Silicate at first impregnation, and 0.4% TA, 0.6% $H_2O_2$, 0.14% DTPA, 0.05% $MgSO_4$, 0.4% Silicate at second stage impregnation. For spruce, using similar amounts of AP chemicals, for example see FIG. 16, the blow line series, A6, had a similar or slightly higher brightness of, 78.8% ISO, than the, 78.2% ISO, from the series, A5, where the last stage of AP chemicals were applied at the refiner eye. This slight difference of brightness again was likely a result of combined effects from their slightly different freeness, 47 mL vs. 49 mL, and slightly different light absorption coefficient, 0.56 vs. 0.60 $m^2$/kg.

In the case of red pine, the blow line series, A8, had a slightly higher brightness, 71.8 vs. 71.2% ISO, lower light absorption coefficient, 0.84 vs. 1.01 $m^2$/kg, but higher freeness, 99 vs. 82 mL, compared to the refiner eye series, A7. As far as its effect on brightness is concerned, in this case, the difference in the light absorption coefficient was likely the difference in their freeness. The amounts of AP chemical treatment were the same for both series.

A softwood blend from spruce and pine was subjected to high pressure refining at the refiner chemical treatment stage as in FIG. 17.

In this case, a RT-Pressafiner was used at the first stage impregnation, and Andritz Model 560GS Impressafiner at the second stage. For this chemical treatment 0.4% TA, 0.6% $H_2O_2$, 0.18% DTPA, 0.03% $MgSO_4$ and 0.3% Sodium Silicate at $1^{st}$ stage chip impregnation; 0.4% TA, 0.7% $H_2O_2$, 0.15% DTPA, 0.05% $MgSO_4$ and 0.4% Sodium Silicate at $2^{nd}$ stage chip impregnation; 0.9% TA, 1.5% $H_2O_2$, 0.18% DTPA, 0.09% $MgSO_4$ and 1.8% Sodium Silicate at refiner chemical treatment stage, either at the refiner eye as for A9, or the intermediate line as for A10 was used. Series, A9, A10, were performed, and both had similar chemical charges and recipe, but one (A9) had 2.1 bar pressure in the primary refiner and the other, A10, 4.2 bar. FIG. 17 presents results, and shows that the series with the higher pressure, A10, was able to achieve similar bleaching efficiency and brightness (using 1.7% TA and 2.8% $H_2O_2$ and reached 73.7-73.4% ISO). The samples had similar light absorption coefficient (0.96-1.1 $m^2$/kg). These results indicate that when the chemical strategies were optimized, a similar bleaching efficiency and brightness (at least in the range of 70-75% ISO) can be achieved at even a very high pressure (4.2 bar, or 60 psi). The high pressure refining would make it possible to recover high quality steam with better efficiency than the lower pressures, and provide an opportunity to reduce shives (fiber bundles) for high freeness pulps.

The invention claimed is:

1. An alkaline peroxide mechanical pulping process consisting of the steps of:

feeding a lignocellulosic material into a first press;

pressing the lignocellulosic material;

discharging the lignocellulosic material from the first press;

impregnating the lignocellulosic material discharged from the first press with a first sodium hydroxide alkaline peroxide pretreatment solution and maintaining the impregnation for a first reaction time to produce an impregnated lignocellulosic material;

feeding the impregnated lignocellulosic material impregnated with said first sodium hydroxide alkaline peroxide pretreatment solution to a refiner having an inlet and a rotating disc within a superatmospheric casing;

refining the impregnated lignocellulosic material to form a primary pulp having a temperature of at least about 80° C.;

delivering a stream of primary pulp from the superatmospheric casing through a blow valve to a blow line while the primary pulp temperature is at least about 80° C.;

adding a sodium hydroxide alkaline peroxide blow line solution to the stream of primary pulp in the blow line while the primary pulp temperature is at least about 80° C.;

mixing the blow line solution and the stream of primary pulp to form a reaction mixture in the blow line;

discharging the reaction mixture having a temperature of at least about 80° C. into a retention vessel; and retaining the reaction mixture in the retention vessel to produce a bleached material.

2. The alkaline peroxide mechanical pulping process of claim 1, wherein the step of feeding the impregnated lignocellulosic material to a refiner having an inlet and a rotating disc within a superatmospheric casing includes maintaining the superatmospheric casing at a pressure of at least about 240 kPa.

3. The alkaline peroxide mechanical pulping process of claim 1, wherein the step of adding an alkaline peroxide blow line solution to the stream of primary pulp includes adding the blow line solution immediately after the blow valve.

4. The alkaline peroxide mechanical pulping process of claim 1, wherein the step of delivering a stream of primary pulp from the superatmospheric casing to the blow line further includes the primary pulp having a temperature in the range of about 90° C. to about 155° C. and a consistency of about 20 to about 60%.

5. The alkaline peroxide mechanical pulping process of claim 1, wherein the reaction mixture is retained in the retention vessel at a temperature of about 60° C. to about 95° C. and a consistency of about 20% to about 40%.

6. The alkaline peroxide mechanical pulping process of claim 1, wherein the reaction mixture is retained in the retention vessel at a temperature of about 85° C. to about 95° C., and a consistency of about 30%.

7. The alkaline peroxide mechanical pulping process of claim 1, wherein the pretreatment solution contains sodium hydroxide, peroxide, and stabilizer; the blow line solution contains sodium hydroxide, peroxide, and stabilizer; and said blow line solution has a temperature less than about 80° C.

8. The alkaline peroxide mechanical pulping process of claim 1, wherein more than one third of the total sodium hydroxide alkaline peroxide solution added from impregnation to the blow line inclusive, is added at the blow line.

9. An alkaline peroxide mechanical pulping process consisting of the steps of:

feeding a lignocellulosic material into a first press;

pressing the lignocellulosic material;

discharging the lignocellulosic material from the first press;

impregnating the lignocellulosic material discharged from the first press with a first sodium hydroxide alkaline peroxide pretreatment solution and maintaining the impregnation for a first reaction time;

feeding the lignocellulosic material that has been impregnated with the first sodium hydroxide alkaline peroxide pretreatment solution for a first reaction time, into a second press;

pressing and discharging the lignocellulosic material from the second press;

impregnating the lignocellulosic material discharged from the second press with a second sodium hydroxide alkaline peroxide pretreatment solution and maintaining the second impregnation for a second reaction time to produce a second impregnated lignocellulosic material;

feeding the second impregnated lignocellulosic material impregnated with said second sodium hydroxide alkaline peroxide pretreatment solution to a refiner having an inlet and a rotating disc within a superatmospheric casing;

refining the impregnated lignocellulosic material to form a primary pulp having a temperature of at least about 80° C.;

delivering a stream of primary pulp from the superatmospheric casing through a blow valve to a blow line while the primary pulp temperature is at least about 80° C.;

adding a sodium hydroxide alkaline peroxide blow line solution to the stream of primary pulp in the blow line while the primary pulp temperature is at least about 80° C.;

mixing the blow line solution and the stream of primary pulp to form a reaction mixture in the blow line;

discharging the reaction mixture having a temperature of at least about 80° C. into a retention vessel; and retaining the reaction mixture in the retention vessel to produce a bleached material.

10. The alkaline peroxide mechanical pulping process of claim 9, wherein the first pretreatment solution contains 0.3% DTPA; the second impregnation solution contains by weight per cent 0.2% $MgSO_4$, 4.4% silicate, 2.8% TA, and 2.8% $H_2O_2$; and the blow line solution contains by weight per cent 0.16% DTPA, 0.16% $MgSO_4$, 2.3% silicate, 1.8% TA with 0.5% being residual, 2.4% $H_2O_2$ with 1.1% being residual.

11. The alkaline peroxide mechanical pulping process of claim 9, wherein the first impregnation solution contains by weight per cent 0.5% DTPA; the second impregnation solution contains by weight per cent 0.2% DTPA, 0.1% $MgSO_4$, 2.0% silicate, 1.6% TA, and 2.6% $H_2O_2$; and the blow line solution contains by weight per cent 0.13% DTPA, 0.13% $MgSO_4$, 2.5% silicate, 1.2% TA with 0.1% being residual, 2.1% $H_2O_2$ with 2.1% being residual.

12. The alkaline peroxide mechanical pulping process of claim 9, wherein the first impregnation solution contains by weight per cent 0.3% DTPA, 0.05% $MgSO_4$, 0.7% silicate, 0.2% TA, and 0.5% $H_2O_2$; the second impregnation solution contains by weight per cent 0.1% DTPA, 0.08% $MgSO_4$, 1.8% silicate 1.4% TA, and 1.9% $H_2O_2$; and the blow line solution contains by weight per cent 0.22% DTPA, 0.11% $MgSO_4$, 1.1% silicate, 0.9% TA with 0.2% being residual, 1.2% $H_2O_2$ with 1.7% being residual.

13. The alkaline peroxide mechanical pulping process of claim 9, wherein the first impregnation solution contains by weight per cent 0.4% TA, 0.5% $H_2O_2$, 0.2% DTPA, 0.04% $MgSO_4$, 0.5% silicate; the second impregnation solution contains by weight per cent 0.14% DTPA, 0.05% $MgSO_4$, 0.05% silicate, 0.4% TA, and 0.6% $H_2O_2$; and the blow line solution contains by weight per cent 0.18% DTPA, 0.06% $MgSO_4$, 1.8% silicate, 1.2% TA with 0.1% being residual, 1.8% $H_2O_2$ with 1.1% being residual.

14. The alkaline peroxide mechanical pulping process of claim 9, wherein the first impregnation solution contains by weight per cent 0.4% TA, 0.6% $H_2O_2$, 0.18% DTPA, 0.03% $MgSO_4$, 0.3% silicate; the second impregnation solution contains by weight per cent 0.15% DTPA, 0.05% $MgSO_4$, 0.4% silicate, 0.4% TA, and 0.7% $H_2O_2$; and the blow line solution contains by weight per cent 1.7% TA, and 2.8% $H_2O_2$ with 1.1% being residual.

15. The alkaline peroxide mechanical pulping process of claim 9, wherein the step of feeding the impregnated lignocellulosic material to a refiner having an inlet and a rotating disc within a superatmospheric casing includes maintaining the superatmospheric casing at a pressure of at least about 240 kPa.

16. An alkaline peroxide mechanical pulping process consisting of the steps of:

in a primary refiner having a superatmospheric casing, refining a lignocellulosic material that has been pretreated and impregnated with only a first sodium hydroxide alkaline peroxide pretreatment solution;

discharging the lignocellulosic material at a temperature of at least about 80° C. into a blow line having at least one solution inlet port;

injecting a sodium hydroxide alkaline peroxide blow line solution through the at least one solution inlet port;

mixing the blow line solution and the lignocellulosic material in the blow line;

discharging the lignocellulosic material from the blow line at a temperature of at least about 80° C.; and retaining the discharged lignocellulosic material for a reaction period in a retention tower.

17. The alkaline peroxide mechanical pulping process of claim 16, wherein the step of refining further includes adding a refiner solution of sodium hydroxide alkaline peroxide at the primary refiner.

18. The alkaline peroxide mechanical pulping process of claim 16, wherein the step of injection an alkaline peroxide blow line solution through the at least one solution inlet port and into the blow line containing the lignocellulosic material includes injecting an alkaline peroxide blowline line solution through, at least, one solution inlet port located immediately after the blow valve.

19. An alkaline peroxide mechanical pulping process consisting of the steps of:

feeding a lignocellulosic material into a first press;

pressing the lignocellulosic material;

discharging the lignocellulosic material from the first press;

impregnating the lignocellulosic material discharged from the first press with a first sodium hydroxide alkaline peroxide pretreatment solution and maintaining the impregnation for a first reaction time to produce an impregnated lignocellulosic material;

feeding the impregnated lignocellulosic material impregnated with said first sodium hydroxide alkaline peroxide pretreatment solution to a refiner having an inlet and a rotating disc within a superatmospheric casing;

refining the impregnated lignocellulosic material to form a primary pulp;

discharging the stream of primary pulp from the superatmospheric casing to a blow line;

adding a sodium hydroxide alkaline peroxide blow line solution to the stream of primary pulp immediately after the blow valve;

mixing the blow line solution and the stream of primary pulp to form a reaction mixture;

discharging the reaction mixture into a retention vessel; and retaining the reaction mixture in the retention vessel to produce a bleached material.

20. The alkaline peroxide mechanical pulping process of claim 19, wherein the step of feeding the impregnated lignocellulosic material to a refiner having an inlet and a rotating disc within a superatmospheric casing includes maintaining the superatmospheric casing at a pressure of at least about 240 kPa.

21. The alkaline peroxide mechanical pulping process of claim 19, wherein the impregnation solution contains sodium hydroxide, peroxide, and stabilizer; the blow line solution contains sodium hydroxide, peroxide and stabilizer; and said blow line solution is at a temperature less then the stream of primary pulp.

22. The alkaline peroxide mechanical pulping process of claim 19, wherein more than one third of the total sodium hydroxide alkaline peroxide solution added from impregnation to the blow line inclusive, is added at the blow line.

23. An alkaline peroxide mechanical pulping process consisting of the steps of:

feeding a lignocellulosic material into a first press;

pressing the lignocellulosic material;

discharging the lignocellulosic material from the first press;

impregnating the lignocellulosic material discharged from the first press with a first sodium hydroxide alkaline peroxide pretreatment solution and maintaining the impregnation for a first reaction time to produce a first impregnated lignocellulosic material;

feeding the lignocellulosic material that has been impregnated with the first sodium hydroxide alkaline peroxide pretreatment solution for a first reaction time, into a second press;

pressing and discharging the lignocellulosic material from the second press;

impregnating the lignocellulosic material discharged from the second press with a second sodium hydroxide alkaline peroxide pretreatment solution and maintaining the second impregnation for a second reaction time to produce a second impregnated lignocellulosic material;

feeding the second impregnated lignocellulosic material impregnated with said second sodium hydroxide alkaline peroxide pretreatment solution to a refiner having an inlet and a rotating disc within a superatmospherie casing;

refining the impregnated lignocellulosic material to form a primary pulp;

discharging the stream of primary pulp from the superatmospheric casing to a blow line;

adding a sodium hydroxide alkaline peroxide blow line solution to the stream of primary pulp immediately after the blow valve;

mixing the blow line solution and the stream of primary pulp to form a reaction mixture;

discharging the reaction mixture into a retention vessel; and retaining the reaction mixture in the retention vessel to produce a bleached material.

24. The alkaline peroxide mechanical pulping process of claim 23, wherein the first impregnation solution contains by weight per cent 0.3% DTPA; the second impregnation solution contains by weight per cent 0.2% $MgSO_4$, 4.4% silicate, 2.8% TA, and 2.8% $H_2O_2$; and the blow line solution contains by weight per cent 0.16% DTPA, 0.16% $MgSO_4$, 2.3% silicate, 1.8% TA with 0.5% being residual, 2.4% $H_2O_2$ with 1.1% being residual.

25. The alkaline peroxide mechanical pulping process of claim 23, wherein the first impregnation solution contains by weight per cent 0.5% DTPA; the second impregnation solution contains by weight per cent 0.2% DTPA, 0.1% $MgSO_4$, 2.0% silicate, 1.6% TA, and 2.6% $H_2O_2$; and the blow line solution contains by weight per cent 0.13% DTPA, 0.13% $MgSO_4$, 2.5% silicate, 1.2% TA with 0.1% being residual, 2.1% $H_2O_2$ with 2.1% being residual.

26. The alkaline peroxide mechanical pulping process of claim 23, wherein the first impregnation solution contains by weight per cent 0.3% DTPA, 0.05% $MgSO_4$, 0.7% silicate, 0.2% TA, and 0.5% $H_2O_2$; the second impregnation solution contains by weight per cent 0.1% DTPA, 0.08% $MgSO_4$, 1.8% silicate, 1.4% TA, and 1.9% $H_2O_2$; and the blow line solution contains by weight per cent 0.22% DTPA, 0.11% $MgSO_4$, 1.1% silicate, 0.9% TA with 0.2% being residual, 1.2% $H_2O_2$ with 1.7% being residual.

27. The alkaline peroxide mechanical pulping process of claim 23, wherein the first impregnation solution contains by weight percent 0.4% TA, 0.5% $H_2O_2$, 0.2% DTPA, 0.04 $MgSO_4$, 0.5% silicate; the second impregnation solution contains by weight per cent 0.14% DTPA, 0.05% $MgSO_4$, 0.5% silicate, 0.4% TA, and 0.6% $H_2O_2$; and the blow line solution contains by weight per cent 0.18% DTPA, 0.06% $MgSO_4$, 1.8% silicate, 1.2% TA with 0.1% being residual, 1.8% $H_2O_2$ with 1.1% being residual.

28. The alkaline peroxide mechanical pulping process of claim 23, wherein the first impregnation solution contains by weight per cent 0.4% TA, 0.6% $H_2O_2$, 0.18% DTPA, 0.03% $MgSO_4$, 0.3% silicate; the second impregnation solution contains by weight per cent 0.15% DTPA, 0.05% $MgSO_4$, 0.4% silicate, 0.4% TA, and 0.7% $H_2O_2$; and the blow line solution contains by weight per cent 1.7% TA and 2.8% $H_2O_2$ with 1.1% being residual.

29. An alkaline peroxide mechanical pulping process consisting of the steps of:

in a primary refiner having a superatmospheric casing, refining a lignocellulosic material that has been pretreated and impregnated with only a first sodium hydroxide alkaline peroxide pretreatment solution into a primary pulp having a temperature in the range of about 90° C. to about 155° C. and a consistency of about 20 to about 60%;

discharging the lignocellulosic material through a blow valve into an intermediate line in fluid communication with at least a first further pulp processing apparatus for separating, cleaning; pressing, bleaching, or refining the primary pulp and having at least one solution inlet port upstream of said further apparatus;

injecting sodium hydroxide alkaline peroxide intermediate line solution through the at least one solution inlet port at a temperature below about 80° C.;

mixing the intermediate line solution and the lignocellulosic material in the intermediate line upstream of said further apparatus;

discharging the lignocellulosic material from the intermediate line; and retaining the discharged lignocellulosic material for a reaction period in a retention tower.

30. The alkaline peroxide mechanical pulping process of claim 29, wherein the step of refining further includes adding a refiner sodium hydroxide solution of alkaline peroxide at the primary refiner.

31. The alkaline peroxide mechanical pulping process of claim 30, wherein more than one third of the total sodium hydroxide alkaline peroxide solution added from impregnation to the intermediate line inclusive, is added at the intermediate line.

32. The alkaline peroxide mechanical pulping process of claim 29, wherein the step of injecting an alkaline peroxide intermediate line solution through the, at least one, solution inlet port and into the intermediate line containing the lignocellulosic material includes injecting an alkaline peroxide intermediate line solution through, at least, one solution inlet port located immediately after said blow valve.

33. The alkaline peroxide mechanical pulping process of claim 29, wherein more than one third of the total sodium hydroxide alkaline peroxide solution added from impregnation to the intermediate line inclusive, is added at the intermediate line.

* * * * *